US006535195B1

(12) United States Patent
Nelson

(10) Patent No.: US 6,535,195 B1
(45) Date of Patent: Mar. 18, 2003

(54) LARGE-AREA, ACTIVE-BACKLIGHT DISPLAY

(76) Inventor: Terence John Nelson, 1260 Springfield Ave., New Providence, NJ (US) 07974

( * ) Notice: Subject to any disclaimer, the term of this patent is extended or adjusted under 35 U.S.C. 154(b) by 240 days.

(21) Appl. No.: 09/655,388

(22) Filed: Sep. 5, 2000

(51) Int. Cl.[7] ..... G09G 3/36

(52) U.S. Cl. ..... 345/102; 345/87; 345/100

(58) Field of Search ..... 345/102, 103, 345/104, 87, 89, 88, 98, 100

(56) References Cited

U.S. PATENT DOCUMENTS 4,958,915 A * 9/1990 Okada et al. ..... 350/345
5,592,193 A * 1/1997 Chen ..... 345/102

* cited by examiner

*Primary Examiner*—Steven Saras
*Assistant Examiner*—Alecia D. Nelson

(57) ABSTRACT

A low-cost, large-area display system having a backlight in segments each positioned to illuminate a subfield of M rows of a fast supertwisted-nematic (STN) display of N rows. Fields of Q+1 subfields are addressed by the method known as Active Addressing using orthogonal waveforms of period MT/N where T is the frame time. A subfield is addressed for Q+1 periods MT/N of the row waveforms and illuminated during the last one. Fast STNs allow Q to be small leading to a small effective multiplex ratio with improved contrast and horizontal viewing-angle range. A few additional leading and trailing rows may be addressed to overcome vertical parallax. The row drivers are periodically connected by switches that simply ground un-addressed rows. With Q+1 also a divisor of N, subfield contributions to the column waveforms can be calculated once and used Q+1 times in each frame. For example, N=240, M=16, L=4 and Q=2 provide an effective multiplex ratio of 57 and allow at least 2.2 msec for pixels to turn on when the frame rate 1/T is 60 Hz. The viewing-angle range can also be expanded by moving subfields a few rows in the scan direction and advancing the integration time to equalize the brightness of pixels illuminated by the next segment. For example, if the turn-off time is 0.76 T and the integration time is shortened to 0.33 MT/N, equalization is possible with turn-on times as large as ¾ of the turn-off time without decreasing pixel transmittance by more than 50%. Dual-scan configurations using N=240, for example, can display VGA or 480 p formats.

16 Claims, 13 Drawing Sheets

LARGE-AREA, ACTIVE-BACKLIGHT DISPLAY

FIELD OF THE INVENTION

The present invention is directed to the problem of addressing large-area liquid-crystal displays that do not require the costly processing steps: needed to incorporate a thin-film transistor, or some other switching device, into each subpixel.

BACKGROUND OF THE INVENTION

The liquid-crystal displays currently used on most portable computers are classifiable as active-matrix LCDs. An active, i.e. switching, device incorporated into each subpixel of these displays transfers and holds a specified charge on a transparent electrode. These switches are typically field-effect transistors formed in thin films of amorphous silicon, or sometimes polycrystalline silicon. However, the capital investment required for the equipment needed to deposit silicon and form thin-film transistors (TFTs) with the necessary electronic switching behavior is high. Furthermore, this large investment must be repeated for each new generation of processing equipment capable of handling larger glass substrates. It appears now that the next (fourth) generation TFT-LCD fabs will use 800-mm by 950-mm substrates. The capital cost of the processing equipment per substrate divided by the number of 17.x-inch displays in the array (6), taking the yield of individual displays into account, should be attractive for desktop computing in the next few years.

Making large TFT-LCD backplanes one at a time in a 4th-generation fab would be inappropriate for a cost-sensitive application like consumer television. In the first place, the capital expense would be concentrated 6-fold compared to the 17.x-inch desktop display scenario. Furthermore, the yield for such large backplanes would be lower, raising the cost even higher. Finally, the maximum size at the desirable 16 by 9 aspect ratio would only be about 42 inches in diagonal, which is of marginal interest for standard definition (480-line) digital TV and clearly too small for high-definition (720-line or better) TV in the US market. In order to make LCDs at larger sizes and lower costs, it seems to be necessary to forego the advantages associated with creating an active element to control each sub-pixel.

On several occasions over the past quarter of a century, LCD technologists overcame what turned out to be only apparent limits to the information content that can be displayed without using active switching elements. FIG. 1 illustrates the first approach to this problem, which was described by Allan R. Kmetz in "Liquid-Crystal Display Prospects in Perspective," IEEE Transactions on Electron Devices, Vol. ED-20 (1973) pp. 954–961. The pixels in a row are addressed together by applying a "select" pulse to one row at a time while "data" voltages are presented to the columns. All other (i.e. unselected) rows are kept at ground potential. The display is scanned, which means repeating this process for each row until all: the rows are addressed in what is called a frame. Therefore, addressing voltage waveforms must be repeated at some acceptable frame frequency. This frame rate is typically chosen to be at least 30 Hz so that the illusion of continuous motion can be created as the pixel patterns change from one frame to the next. However, it should be noted that the response time of the LCD may be different from the frame time.

The voltage applied to a pixel in FIG. 1 is equal to the difference between the select and data-voltage waveforms on the two electrodes defining that pixel. A larger voltage appears across the pixel if the row and column voltages have opposite sign. Now, it was known experimentally that nematic liquid crystals respond to the RMS (root mean-square or AC average) of the voltage applied to them. Choosing the data waveform to be $\pm V_0$ makes the undesirable contribution to the RMS voltage (applied when other rows are being addressed) independent of the image. Furthermore, choosing, the select-pulse voltage $V_S$ to be exactly twice the magnitude, of the data voltage causes the voltage applied to an off pixel while it is being addressed to have this same value also. Thus the RMS voltage applied to an off pixel is $V_0$ independent of the rest of the image. The voltage applied to turn a pixel on is $3V_0$ while the pixel is being addressed and $\pm V_0$ the rest of the time. If there are N rows to be addressed, the ratio of the RMS voltages $V_{ON}/V_{OFF}$ turns out to be $$\frac{V_{ON}}{V_{OFF}} = \left(1 + \frac{8}{N}\right)^{1/2}. \tag{1}$$

This ratio is not very large for N=240, which is appropriate for VGA or SDTV in the dual-scan configuration where the columns are split in the middle and independently driven from the top and the bottom. Although the rows are also independently driven, the two halves of a dual-scan display can be synchronized if necessary. Now the value of $V_{ON}/V_{OFF}$ that will be required to address a display depends on the details of the liquid-crystal composition and alignment. Turning the relationship around, we can see that this 3:1 method of addressing limits the number of addressable rows to:

$$N = \frac{8}{\left(\frac{V_{ON}}{V_{OFF}}\right)^2 - 1}, \tag{2}$$

when the on/off ratio is specified. For example, if the minimum ratio available is 1.2, only about 18 rows can be addressed. A dual-scanned display could have twice as many rows, but the total would still be discouragingly low for general purposes. For the more interesting case of $N_{MAX}$= 240, which allows a VGA or SDTV format with dual scanning, the on/off voltage ratio available is about 1.0165. This ratio was inadequate to switch known liquid-crystal configurations.

The 3:1 addressing scheme was predicated on the assumption that the RMS values of the unselected and off voltages should be the same. Whatever benefits that might have, it is not the same thing as maximizing the on/off ratio for a given number of rows. Paul M. Alt and Peter Pleshko showed this in "Scanning Limitations of Liquid-Crystal Displays," which appeared in IEEE Transactions on Electron Devices, Vol. ED-21 (1974) on pp. 146–155. In fact, a bigger on/off ratio can be obtained by increasing the select voltage relative to the data voltage as shown by the dashed pulse waveform in FIG. 1. The optimum ratio according to Alt and Pleshko is given by:

$$\frac{V_S}{V_0} = N^{1/2}. \tag{3}$$

On the other hand, for a given value of the ratio of the RMS values of the on and off voltages, the maximum number of rows that can be addressed is given by:

$$N_{MAX} = \left( \frac{\left(\frac{V_{ON}}{V_{OFF}}\right)^2 + 1}{\left(\frac{V_{ON}}{V_{OFF}}\right)^2 - 1} \right)^2. \quad (4)$$

For the interesting case of N=240, the on/off ratio that is needed turns out to be about 1.067. That was a big improvement over 3:1 addressing, but to be generally useful, a liquid-crystal configuration that could be switched by such a small ratio was still needed.

In 1985, Scheffer et al. reported their work on a liquid-crystal configuration that does respond to a reduced on/off voltage ratio in "24×80 Character LCD Panel Using the Supertwisted Birefringence Effect," 1985 SID Symposium Digest of Papers, Vol. 16, pp. 120–123. This was the beginning of a new generation of what are now called supertwist or STN displays because the nematic liquid crystal twists by more than 90 degrees between the front and back substrates. STN displays with 240:1 multiplexing can be made to switch within the narrow voltage range available in Alt-Pleshko addressing. Dual-scan VGA STN displays have been used successfully for notebook computers but they were originally not practical at video rates. Of course, faster response can be obtained in active-matrix LCDs, where a thin-film switch is provided to control each sub-pixel. Unfortunately, AMLCDs are prohibitively expensive in the large sizes desirable for family entertainment. Furthermore, they have motion artifacts caused by the memory of the pixels between successive address times. This is because the human visual system tries to track an element moving quickly across a display, and the excessive persistence of the pixels smears the perceived image.

STN LCDs can be made with a fast-responding liquid-crystal material, but pixels relax between successive selections of the rows defining them when conventional Alt-Pleshko waveforms are used. This relaxation, which is called "frame response," can be substantially complete in a typical frame time of 1/60 sec. FIG. 2 illustrates pixel voltage and transmission waveforms for such extreme frame response. Y. Kaneko et al., first discussed frame response in a paper on "Full-Color STN Video LCDs," which appeared in the Proceedings of Eurodisplay '90, pp. 100–103. Up to that time, slow-responding liquid-crystal materials were often used, and STNs were sometimes erroneously thought to be inherently slow. However, Kaneko, et. al also showed that a fast-responding STN can be driven to its high-transmission state much faster than it relaxes back to low transmission in response to internal forces.

U.S. Pat. No. 5,420,604 "LCD Addressing System," by Terry J. Scheffer and Benjamin R. Clifton, and issued on May 30, 1995, provides a method for addressing high-information-content LCD panels in which a fast-responding liquid-crystal material can be used. In this method, shown conceptually in FIG. 3, the row electrodes 0,1, . . . ,N−1 of the matrix are continuously driven by a set of orthogonal voltage waveforms $F_1$, $F_2$, . . . $F_N$ having a common period T. One way to construct orthogonal functions is to use harmonics of fundamental sine and cosine functions that have period T. Generally, the maximum frequency required to construct a set of N orthogonal functions is proportional to N. A particular column-voltage waveform $G_j$ is formed by weighting the row waveforms with the pixel values corresponding to each row in that column. This method, which has been termed "Active Addressing," provides the same on/off voltage ratio as Alt-Pleshko addressing, but the differential voltage delivered to an on pixel is spread throughout the frame time. Although this method substantially eliminates frame response, the viewing-angle range remains narrow at 240:1 multiplexing. Consequently, Active Addressing is beneficial for notebook computer displays, but it does not allow STNs to be made that are suitable for family entertainment.

K. F. Kongslie, R. G. Culter and P. J. Bos proposed another way to reduce frame response in their paper on "A Synchronously Strobed Backlight for Improved Video-Rate STN Performance," 1994 SID Symposium Digest, Vol. 25, pp. 155–158. As shown in FIG. 4, the backlight consisted of a scannable array of 16 tubular fluorescent lamps. The lamps were pulsed one at a time, with variable delay, as the Alt-Pleshko addressing waveforms scanned through the adjacent rows of the display. A modest improvement in contrast was reported at the optimal delay, but it was not high enough for a video display. Furthermore, the experimental display required 75 ms to go from 10% transmission to 90% and vice versa, which is not fast enough for video. Kongslie et. al also reported a cross-talk problem in the vertical direction. This was most likely a parallax effect caused by viewing a row of pixels illuminated by the wrong lamp. Such pixels would show an exaggerated frame response caused by the increased delay between the times of addressing and illumination.

Some other work has been done with segmented backlights. For example, Roger G. Stewart and William R. Roach disclosed a "Field-sequential Display System Utilizing a Backlit LCD Pixel Array and Method For Forming an Image" in U.S. Pat. No. 5,337,068, which was issued on Aug. 9, 1994. In this work, the rows are addressed sequentially, but the problems encountered by Kongslie et. al may be avoided by the use of an active-matrix LCD. Unfortunately, however, a large-area active-matrix LCD would be prohibitively expensive for family entertainment. In U.S. Pat. No. 5,592,193, which issued on Jan. 7, 1997, Hsing-Yao Chen described a "Backlighting arrangement for LCD Display Panel." Here, generally linear arrays of passive liquid-crystal elements are scanned in a sequential manner and illuminated by a partitioned backlight. A plurality of liquid-crystal video elements are activated at a time, but no specific method is given to accomplish this by sequential scanning. A coarsely partitioned backlight would illuminate elements that were scanned at widely varying times, so frame response could reappear to produce a non-uniform appearance within each plurality of elements. On the other hand, a backlight partitioned finely enough to avoid this reappearance of frame response could be costly. Furthermore, no provision was made to eliminate vertical parallax.

Thus there is still no LCD device that is practical at video rates and in the large sizes that are desirable for family entertainment. It is accordingly one object of the present invention to employ a novel driving arrangement in order to achieve uniformity with a scanning backlight and a fast STN display. Another object is to provide a lower effective multiplex ratio in order to obtain better contrast and a wider horizontal viewing-angle range. Yet another object of the invention is to reduce the visual impression of smearing of moving images by reducing the effective persistence of the pixels.

SUMMARY OF THE INVENTION

The display system of the present invention is directed to overcoming image-quality problems that arise according to the prior art when a scanning backlight illuminates a passive-matrix LCD containing a fast-responding liquid-crystal material.

Fast-responding STN LCDs generally turn on significantly faster than they turn off, but it has been difficult to exploit this fact using conventional addressing. An illuminated field of many rows would also show substantial frame response, while it is not practical at present to provide very finely segmented backlights. The present invention is directed to using a technique known as Active Addressing in fields to eliminate this frame response with a relatively coarsely-segmented scanning backlight.

The inventive system has a backlight that is divided into multiple independently addressable segments. A frame store accepts digital images at an input and forwards sub-images for a set of contiguous rows to a field store. A field contains rows that are illuminated by one of the segments. A complete frame is displayed by sequentially displaying all of its fields, and frames are updated at the rate defined at the input, which is commonly 60 Hz.

The controller also synchronizes a row-signal generator and a column-signal generator causing them to output signals to drivers that drive a field in the LCD by the method known as Active Addressing. More specifically, the row-signal generator generates a set of orthogonal waveforms and outputs them to row drivers, which are connected to row conductors on the display through switches. The orthogonal waveforms are independent of the image to be displayed. A column-signal generator receives the orthogonal waveforms from the row-signal generator and adds them together with weights proportional to the pixel values in the associated rows. A column signal is computed separately for each column in the display and sent to column drivers, which are attached to the column conductors in the display.

The period of the orthogonal waveforms is chosen so that each field is addressed for at least two periods. In the second period, after the pixels in a particular subfield have had enough time to turn on, the associated backlight segment illuminates the field thereby displaying its pixels. This backlight segment turns off again and so that the associated field is never displayed when its pixels are in transition or are not being addressed. Active Addressing is effective because the extra contribution to the square of the pixel voltage, which maintains the on state, is distributed throughout the period of the waveforms.

The row drive waveforms are coupled to the fast-responding STN through a set of switches. There is one switch for each row in the whole display and each switch has two positions. When a row is in the addressed range of rows, the row conductor is connected to one of the row drivers. At other times, the row conductor is connected to ground. It is advantageous to provide more row drivers than there are rows in a subfield which is directly in front of a backlight segment. The extra row drivers are used to address a few extra rows above and below the subfield being addressed. This ensures that an observer who views the display from substantially above or below its centerline in a plane perpendicular to the rows will not see unaddressed pixels illuminated by the backlight segement centered behind the current field.

Grounding the unaddressed rows exposes pixels in them to the column waveforms only. While these waveforms explicitly depend on the pixel values in the addressed range, it turns out that the average of the square of the column voltage over a period is also itself independent of the image. This happens automatically when Active Addressing is used to define just on and off pixel states. When the pixel values are defined in a continuous symmetric range, it is not automatic, but an extra orthogonal waveform can be used in the calculation of the column waveforms. The pixel values of the phantom row are chosen to make the average of the squared column voltage independent of the image. This makes the average of the square of an addressed pixel voltage depend only it's particular pixel value even though the pixel values are defined on a continuous range. In the present invention, the phantom row also provides a unique off state from which all pixels make their transitions when addressed. This unique RMS column voltage is equal to the voltage required to turn pixels halfway on divided by the square root of 2. In most cases, it can be substantially below the addressing range so that pixels turn on quickly when addressed.

In an illustrative embodiment, a display of N rows is divided into N/M subfields of M rows each, and L extra rows are addressed in the subfields above and below the current one. The period of the orthogonal row waveforms is MT/2N and each field is addressed for 2 periods. The backlight segment associated with the subfield currently being addressed is pulsed during the second period. The M+2L row drivers are each connected to switches at every M+2L rows. The row-signal generator permutes the signals it delivers to the row drivers and the waveforms are delivered in a fixed order to the column-signal generator. For example, waveform $F_i$ can be assigned to connection $I_C$ given by $((K-K_0)M+i-1)\mathrm{mod}(M+2L)$ where $K_0$ specifies a reference segment where the orthogonal functions $F_i$ are connected to the ith row of the reference field.

An example of the illustrative embodiment is provided by N=240, M=16 and L=4, which are sufficient for a dual-scan VGA or 480p display. The effective multiplex ratio is M+2L+1=25, which is advantageous for obtaining a good horizontal viewing-angle range in planes perpendicular to the columns. It also minimizes the number of row drivers and waveforms. The multiplex ratio could be reduced even more if the emissive surface of the backlight segments can be brought sufficiently close to the LCD. At a frame rate of 60 Hz, MT/2N is about 0.55 msec., which may not be enough time for a fast-responding STN LCD to reach its equilibrium addressed state. Extra time can be provided in this embodiment only to the extent that backlight segments are illuminated for less than 0.55 msec.

In a second embodiment, the rows associated with two or more contiguous backlight segments, plus a few extra rows for parallax reduction, are addressed at one time. While one backlight segment illuminates the rows associated with it, the rows associated with the next one or more backlight segments are pre-addressed. This requires a larger multiplex ratio than the illustrative embodiment, but it allows a liquid crystal with a slower turn-on to be used without reducing the brightness of the display.

The row-signal generator generates (Q+1)M+2L+1 orthogonal signals having period MT/N where Q is a positive integer. Switches are provided at each row to either ground it if it is included in the current field or else to connect it to one of (Q+1)M+2L row drivers. The row-signal generator generates M orthogonal signals for each subfield of the current field. An extra 2L orthogonal waveforms are applied to the first L rows adjacent to the current field in each direction. This provides a correct view in spite of parallax as viewed from directions where a backlight segment illuminates these rows. The final orthogonal signal is not applied to any row, but it is used with phantom pixel values along with the contributions of the (Q+1)M+2L physical rows to the column functions. The phantom pixel values are adjusted to make the average of the column-functions squared independent of the image.

In the second embodiment, (Q+1)M is advantageously also a divisor of N. With this condition, the orthogonal functions applied to the rows i=KM+1, KM+2, . . . (K+1)M can be preassigned to functions $F_I$, where I is given by 1+(i−1)mod M+M(K Mod Q+1). The column functions then include the same weighting of these same M functions each time subfield K is a member of the current field. This contribution of M terms due to a subfield is therefore calculated once in each frame and re-used Q times. The subfield pixel values also contribute to the coefficient of the phantom row waveform, which compensates for the continuous range of the pixel values. This contribution can be reused as well, but it is combined with contributions of other subfields in a non-linear way.

Examples of the second embodiment are provided by N=240, M=15, L=4 and Q=1 or M=16, L=4 and Q=2. The effective multiplex ratio is 39 and the turn-on time can be at least 1.04 msec. when the frame rate is 60 Hz. Now, the period of the row waveforms is exactly twice as long as in the illustrative embodiment. Thus, the maximum frequency of the row waveforms is actually lower than in the illustrative embodiment while the turn-on time available is nearly doubled. In the second case, the multiplex ratio is 57 and the turn-on response time can be at least 2.2 msec. when the frame rate is 60 Hz. The maximum frequency of the row waveforms is only a little greater than in the example of the illustrative embodiment that was considered.

In a third embodiment, no extra rows are driven, and the -number of row-driver connections is (Q+1)M, which is advantageously a divisor of N as in the second embodiment. An expanded viewing-angle range in planes perpendicular to the rows is achieved by offsetting the subfields by L rows with respect to the backlight segments. This offset puts the pixels in the last L rows directly in front of the next backlight segment. They are illuminated by segment L only as viewed from the forward edge of the viewing-angle range. An expanded viewing-angle range is achieved by equalizing the transmission of pixels in subfield K during the integration times of backlight segments K and K+1. This equalization is achieved by advancing the integration time so that it ends before the addressing time ends. In the third embodiment, the pixels in all rows are subject to the same addressing time (Q+1)MT/N. Consequently, a liquid-crystal with a turn-on time that is less than the addressing time can be used. The peak light output of the backlight can be increased to compensate for the reduction in the integration time, which is unavoidable because it provides a range of advancement in which equalization can be accomplished. The requirement for increased peak brightness does not necessarily reduce the efficiency of the display. Of course, the efficiency will be reduced when pixels don't have time to turn on fully and transmit as much light as they could if addressed longer. However, achieving low cost is currently more important than high efficiency for large-area displays for family entertainment.

Equalization is possible over a wide range of turn-on time constants in the example N=240, M=16, Q=2 when the relaxation time constant and the integration time are $\tau_{OFF}/T=T_{INT}/(MT/N)=0.33$. The average pixel transmittance is above 90% for values of $\tau_{ON}/\tau_{OFF}$ below 0.20. However, equalization breaks down at such values because $T_{ADV}+T_{INT}$ rises above MT/N. In this case, the second embodiment could be used because the turn-on time, normally defined as 2.3 $\tau_{ON}$, is sufficiently short. Equalization is possible over a wide range of $\tau_{ON}/\tau_{OFF}$, and the average transmission remains above 50% even up to $\tau_{ON}/\tau_{OFF}=0.75$. Thus the third embodiment can be used even when the turn-on time is not much shorter than the turn-off time.

The organization and operation of this invention will be understood from a consideration of detailed descriptions of illustrative embodiments, which follow, when taken in conjunction with the accompanying drawings.

DETAILED DESCRIPTION OF THE INVENTION

The display system of the present invention is directed to overcoming image-quality problems that arise according to the prior art when a scanning backlight illuminates a passive-matrix LCD containing a fast-responding liquid-crystal material.

Figure 5:
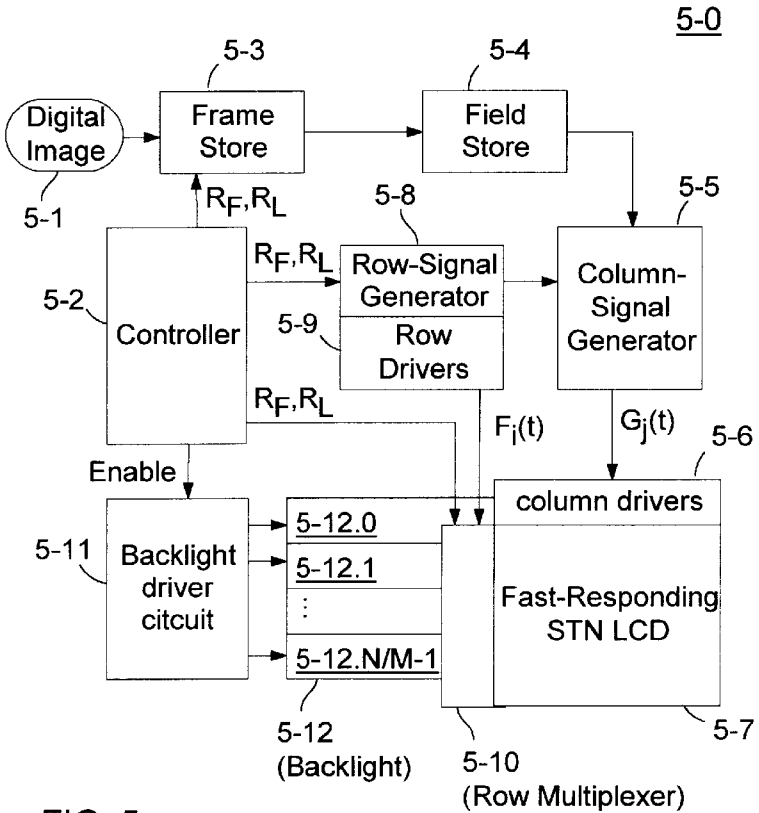
FIG. 5 shows a block diagram of the inventive display system addressing an LCD and an active backlight in multiple fields.

FIG. 5 shows a block diagram of the inventive display system 5-0, which has a frame store 5-3 that accepts digital images 5-1 at an input. A controller 5-2 determines the first and last rows, $R_F$ and $R_L$, of the current field, which is associated with a segmented backlight 5–12 at a segment 5–12.K. The range of rows $[R_F, R_L]$ contains M central rows registered with backlight segment 5–12.K and L extra rows above and below it for a total height of M+2L rows. The rows will be labeled with integers in the range [0,N−1], where N is the total number of rows in the display. The number of rows M per segment and the number of rows N in the display are advantageously chosen so that N/M is an integer. Then $R_F$ and $R_L$ can be computed using modular arithmetic:

$$R_F=(KM-L)\bmod N,$$

$$R_L=((K+1)M+L-1)\bmod N, \tag{5}$$

where K is in the range [0,M/N−1]. For example, M=16 is a divisor of N=240.

The frame store 5-3 receives $[R_F, R_L]$ from the controller 5-2 and outputs the digital sub-image in the selected range of rows to a field store 5-4. The controller also sends $[R_F, R_L]$ to a row-signal generator 5-8, which outputs M+2L row waveforms to row drivers 5-9 and all of these row waveforms plus an extra one to a column-signal generator 5-5. The row waveforms are independent of the image to be displayed. The outputs from the row drivers are connected to the LCD 5-7 through switches in a row multiplexer 5-10. The LCD also accepts column waveforms from the column-signal generator 5-5 through column drivers 5-6. The column-signal generator receives the row waveforms from the row-signal generator and the pixel values in the digital sub-image from the field store and combines them to form the column signals. When the current field of the LCD has been addressed for a sufficiently long time, the controller causes the associated backlight segment 5-12.K to illuminate the display. Pixels in rows that are not being addressed are not illuminated, so their current state is irrelevant except as it affects their response when they are subsequently addressed.

Figure 6:
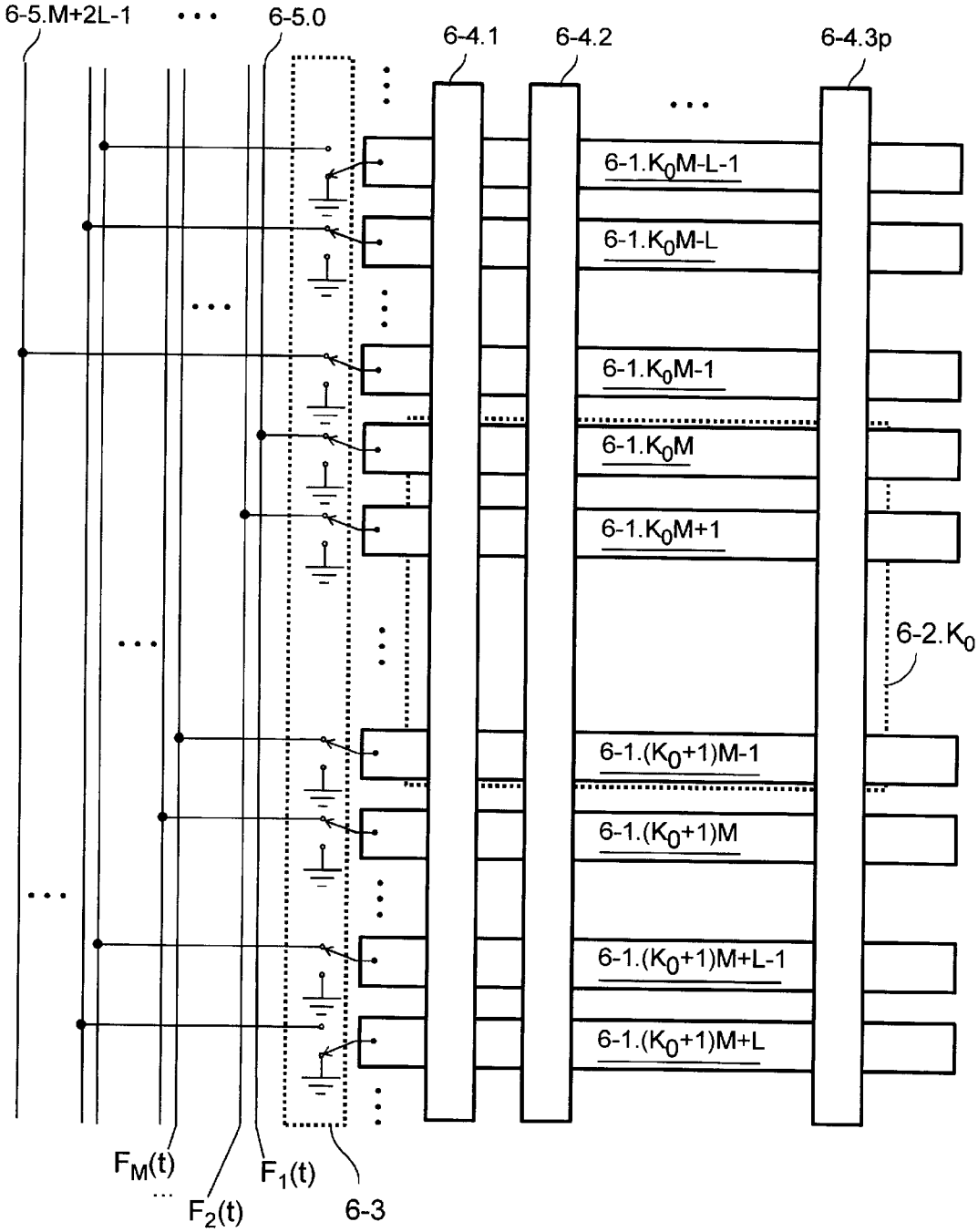
FIG. 6 illustrates a connection pattern of the row drivers to the LCD in an illustrative embodiment of the invention.

FIG. 6 shows how the rows may be connected in an illustrative embodiment of the inventive display system 5-0. The row multiplexer (5-10, 6-3) has switches for independently connecting each row of the LCD. The row multiplexer receives $[R_F, R_L]$ from the controller 5-2 and connects the rows in this range to the row drivers 5-9 through the leads 6-5.0 through 6-5.M+2L−1. The remaining switches are reset and ground-the un-addressed rows of the LCD. The number of rows that are driven independently at one time is illustratively M+2L. Before passing the M+2L signals on to the row drivers, the row-signal generator 5-8 shifts them with respect to the fixed leads 6-5.0 through 6-5.M+2L−1. For example if K=0 specifying the first field, then the row numbers KM−L through KM−1 are negative and should be evaluated modulo N, which places them at the bottom L physical rows of the display. Row-drive waveform $F_1$ is connected through lead 6-5.0 to the row labeled 6-1.$K_0$M in the LCD when segment $K_0$ is addressed for some reference value of $K_0$. The orthogonal functions will be designated $F_i$ where i is in the range [1,M+2L+1]. This avoids designating an orthogonal function with a subscript of zero, which has a special meaning in the mathematical literature on such functions. When the field K is being addressed, the row-signal generator will shift the row-drive waveform $F_i$ by $(K-K_0)M$ to connection 7-5-$I_C$ where:

$$I_C=((K-K_0)M+i-1)\bmod(M+2L), \tag{6}$$

for i in the range [1,M+2L]. There will be an extra orthogonal function $F_{M+2L+1}$ defined, but it will not be applied to any of the physical rows and is therefore never assigned to a connection.

Figure 1:
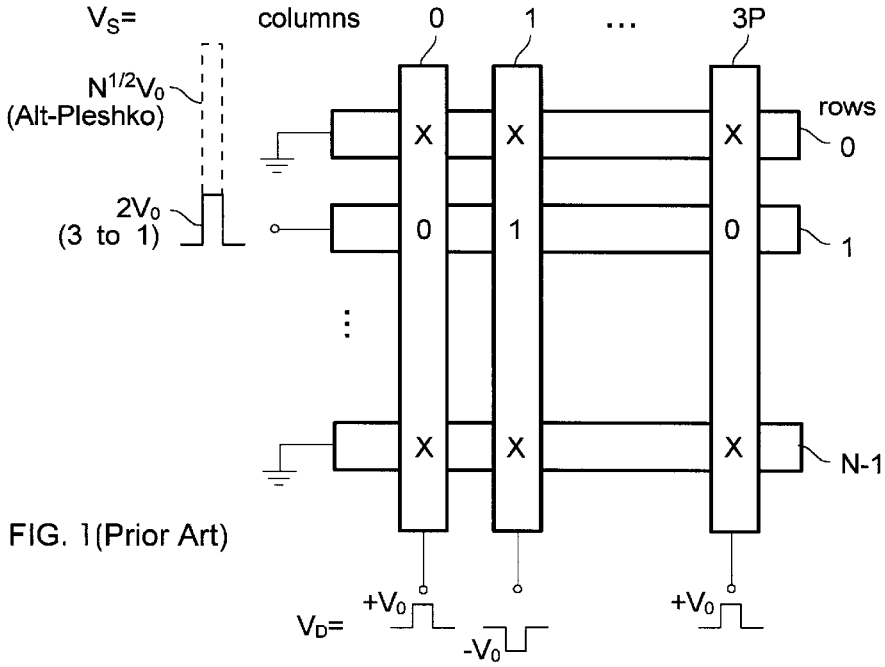
FIG. 1(Prior Art)
FIG. 1 illustrates the prior-art application of coincident select (row) and data (column) voltages to address a liquid-crystal display.
Figure 2:
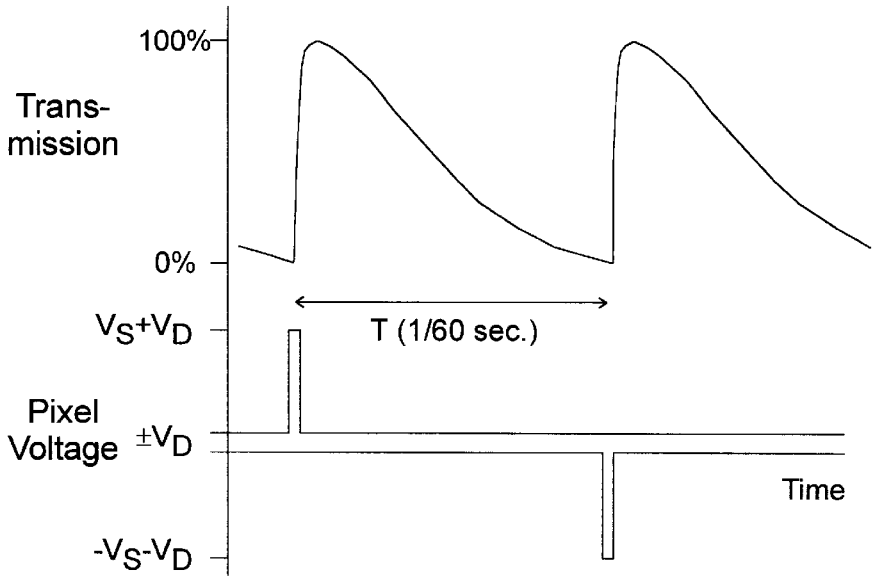
FIG. 2 (Prior Art)
FIG. 2 illustrates the well-known frame-response of a fast-responding liquid-crystal material to Alt-Pleshko addressing.
Figure 4:
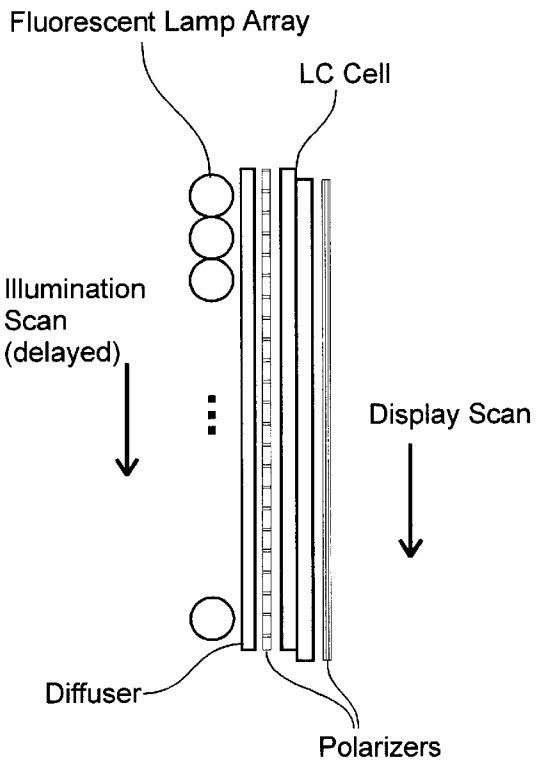
FIG. 4 (Prior Art)
FIG. 4 illustrates a prior-art array of fluorescent tubes being scanned synchronously with addressing waveforms in an STN display.
Figure 3:
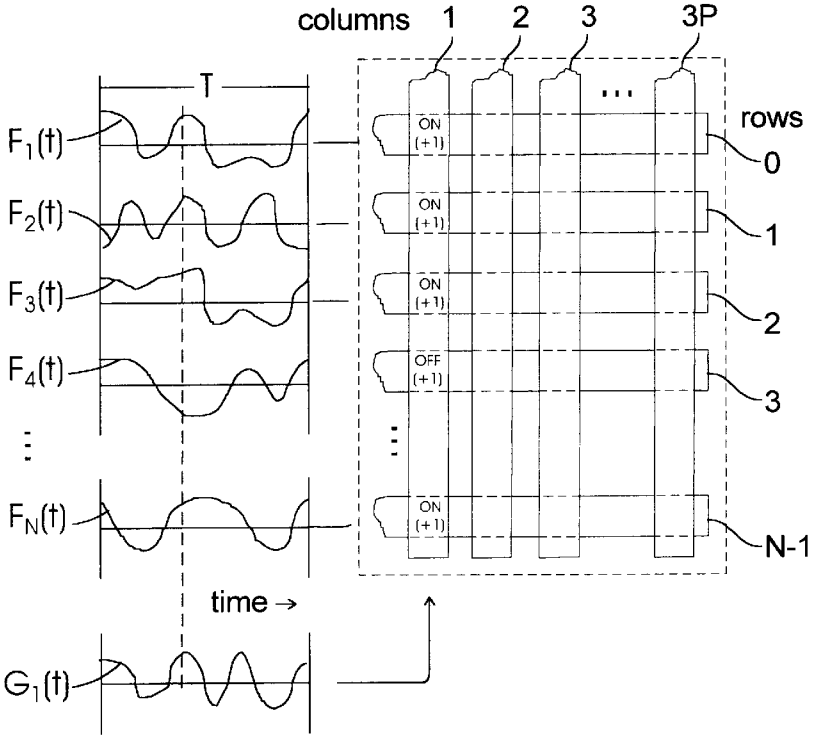
FIG. 3 (Prior Art)
FIG. 3 illustrates the prior-art continuous application of orthogonal waveforms to the rows of a liquid-crystal display and their sum weighted by the pixel values in a column as the column waveform.
Figure 7:
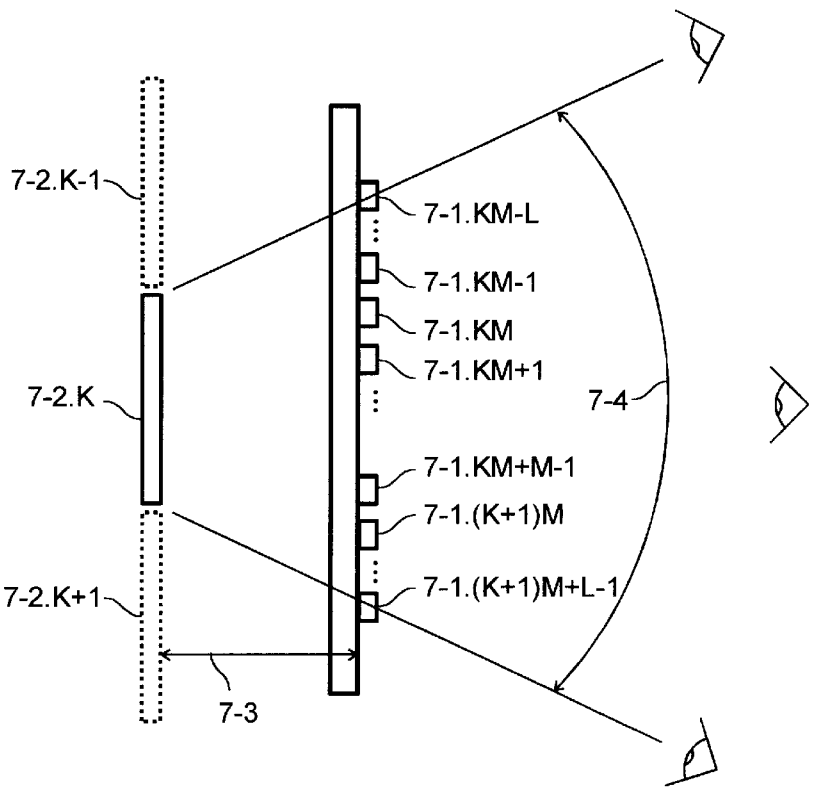
FIG. 7 illustrates the addressing of extra rows above and below the associated backlight segment in order to overcome the effects of parallax.

While M rows are illuminated at one time, parallax introduces some variation as to which M rows are seen from different vantage points as shown in FIG. 7. This is why L extra rows are driven above and below the central group of M rows. This parallax arises because it is hard to completely eliminate the spacing 7-3 between the backlight and the LCD. Thus, an observer who views the display from sufficiently above or below an illuminated segment 7-2.K will not see it through the rows 7-1.KM through 7-1.K(M+1)−1 nominally associated with that segment. To minimize the visual impairment this produces, it is necessary to insure that the pixels in rows 7-1.KM−1 through 7-1.KM−L and 7-1.(K+1)M through 7-1.(K+1)M+L−1 have their correct contrast at the time that segment 7-2.K is illuminated. Other rows above and below these selected rows will not be observable within the vertical viewing-angle range 7-4. For example, with N=240 and M=16, one can choose L=4 to provide 25% additional coverage in each direction for eliminating undesirable parallax effects. For a 240-row screen of height of 12 in, the height per segment is 0.8 in. and the 25% coverage extends 0.2 in. If the liquid crystal itself has good contrast at the extended vertical viewing-angles, the range can be made as large as 90 degrees by reducing the spacing 7-3 between the backlight and the liquid-crystal to 0.2 in.

Figure 8:
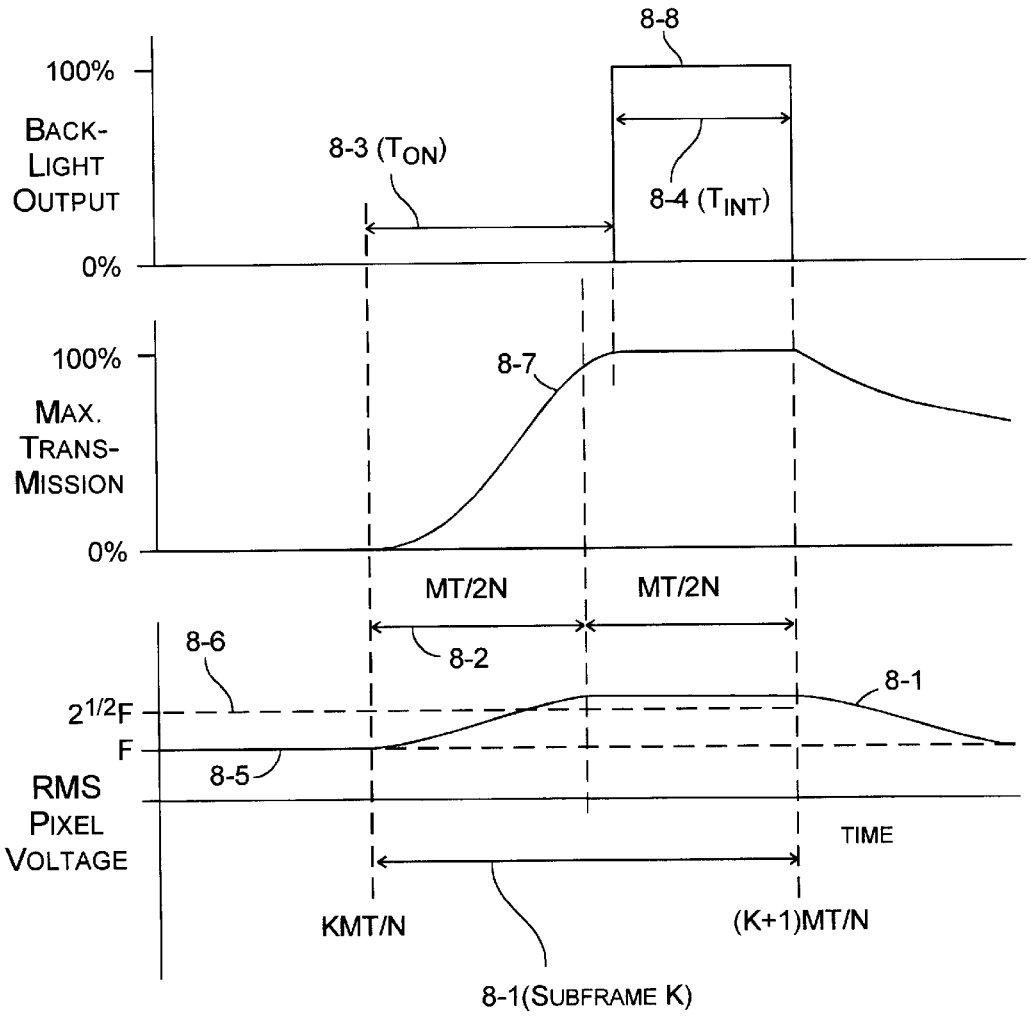
FIG. 8 illustrates the pixel voltage, backlight-segment output and maximum pixel transmission as functions of time in an illustrative embodiment of the inventive display system.

FIG. 8 shows the RMS voltage applied to pixels in subframe K 8-1, the transmission 8-7 of a pixel that is turned on fully, and the timing of the light output 8-8 of the associated backlight segment K. The frame time T is divided into N/M subframes of equal duration MT/N, and each subframe is divided into two halves of equal duration MT2N. Subframe K 8-1 starts at time KMT/N and ends at (K+1)MT/N, and the RMS voltage at t is defined over the period MT/2N ending at that time. During the first half 8-2 of subframe K, pixels associated with the segment K are addressed by the voltages applied to their row and column electrodes. All other row electrodes are grounded. Within a field, the voltage waveforms are defined using the addressing system of U.S. Pat. No. 5,420,604, which is also known as Active Addressing. More particularly, the voltage waveforms $F_i(t)$ applied to its associated rows are defined from a set of M+2L+1 orthogonal functions $f_i(t)$ according to the formula:

$$F_i(t)=\frac{F}{(M+2L+1)^{1/2}}f_i(t), \tag{7}$$

where F is a constant with the dimensions of voltage. The functions $f_i(t)$are periodic with period MT/2N and satisfy the orthonormality condition:

$$\frac{2N}{MT}\int_t^{t+MT/2N} f_i(t')f_j(t')\,dt'=\delta_{ij}. \tag{8}$$

Thus a subframe is taken to be 2 periods of the orthogonal functions. During the first period, the liquid-crystal material responds to an increase in voltage and starts to makes its fast transition into its on condition. During the second half of the subframe, addressing is maintained while the liquid-crystal reaches its prescribed transmission state after being addressed for a total time of $T_{ON}$. The backlight segment is then turned on for the remainder of the subframe, which provides an integration time $T_{int}$ 8-4. The column-voltage waveforms $G_j(t)$ are computed according to the formula:

$$G_j(t) = \left(\frac{1}{M+2L+1}\right)^{1/2} \sum_{i=1}^{M+2L+1} F_i(t) I_{ij}, \tag{9}$$

where $I_{ij}$ is the pixel transmission in the range [−1,1] for i in the range [1,M+2L].

The contribution from last value of i=M+2L+1 in Eq. (9), gives a free parameter $I_{M+2L+1,j}$ for each column because only M+2L physical rows will be actually driven. The free parameters are useful to compensate for the:iextension of $I_{ij}$ to the continuous range of values instead of just the two endpoints ±1. This technique was introduced by Terry J. Scheffer, Arlie R. Connor and Benjamin R. Clifton in U.S. Pat. No. 5,459,495, "Gray Level Addressing for LCDs," which issued on Oct. 17, 1995. The voltage waveform applied to a pixel in the ith row and the jth column while it is being addressed is $$V_{ij}(t)=F_i(t)-G_j(t). \tag{10}$$

Equations (7)–(9)determine that the mean-square value of the addressed pixel voltage is:

$$\frac{2N}{MT}\int_t^{t+MT/2N} (F_i(t') - G_j(t'))^2\, dt' = F^2 - \frac{2F^2}{(M+2L+1)^{1/2}} I_{ij} + \frac{F^2}{M+2L+1} \sum_{k=1}^{M+2L+1} I_{kj}^2. \tag{11}$$

The mean-square voltage applied to un-addressed pixels, on the other hand, is given just by the last term in Eq. (11). Then the free parameters are chosen such that mean-square voltage applied to un-addressed pixels is:

$$\frac{F^2}{M+2L+1} \sum_{k=1}^{M+2L+1} I_{kj}^2 = F^2. \tag{12}$$

The RMS value 8-5 of the voltage applied to unaddressed pixels, which have grounded row conductors, is equal to F, and it is independent of the image being displayed. Thus the unaddressed pixels relax toward a unique state that is independent of the image being displayed. This relaxation is relatively slow. However, unaddressed pixels are not illuminated within the expanded viewing-angle range 7-4, so their state is irrelevant provided they are fast enough to relax between addressing times.

With the normalization condition specified by Eq. (12), the RMS voltage applied to pixels while they are being addressed simplifies to:

$$\left[\frac{2N}{MT}\int_t^{t+MT/2N} (F_i(t') - G_j(t'))^2\, dt'\right]^{1/2} = 2^{1/2} F\left(1 - \frac{I_{ij}}{(M+2L+1)^{1/2}}\right)^{1/2}. \tag{13}$$

Pixels therefore turn on to a state that is independent of the image other than their own pixel value. It then follows that the ratio of the maximum and minimum RMS voltages that can be applied is given by the usual Alt-Pleshko formula for M+2L+1 rows:

$$\frac{V_{ON}}{V_{OFF}} = \left(\frac{1 + \frac{1}{(M+2L+1)^{1/2}}}{1 - \frac{1}{(M+2L+1)^{1/2}}}\right)^{1/2}. \tag{14}$$

The RMS voltage applied to pixels when they are being addressed is about $2^{1/2}$F. This is substantially bigger than the unaddressed RMS pixel voltage F and drives the pixels towards their on state relatively quickly. Furthermore, the transitions start from a unique state provided the pixels have enough time to relax between addressing times. The liquid-crystal configuration is adjusted so that the pixels respond quickly and leave a sufficient integration time $T_{int}$=(MT/N)−$T_{ON}$ to produce the brightness required by the application. For example, if N=240 and M=16, MT/N is about 1.11 msec. when the frame time T is 1/60 sec., and the period of the row waveforms MT/2N is therefore about 0.55 msec.

Figure 9:
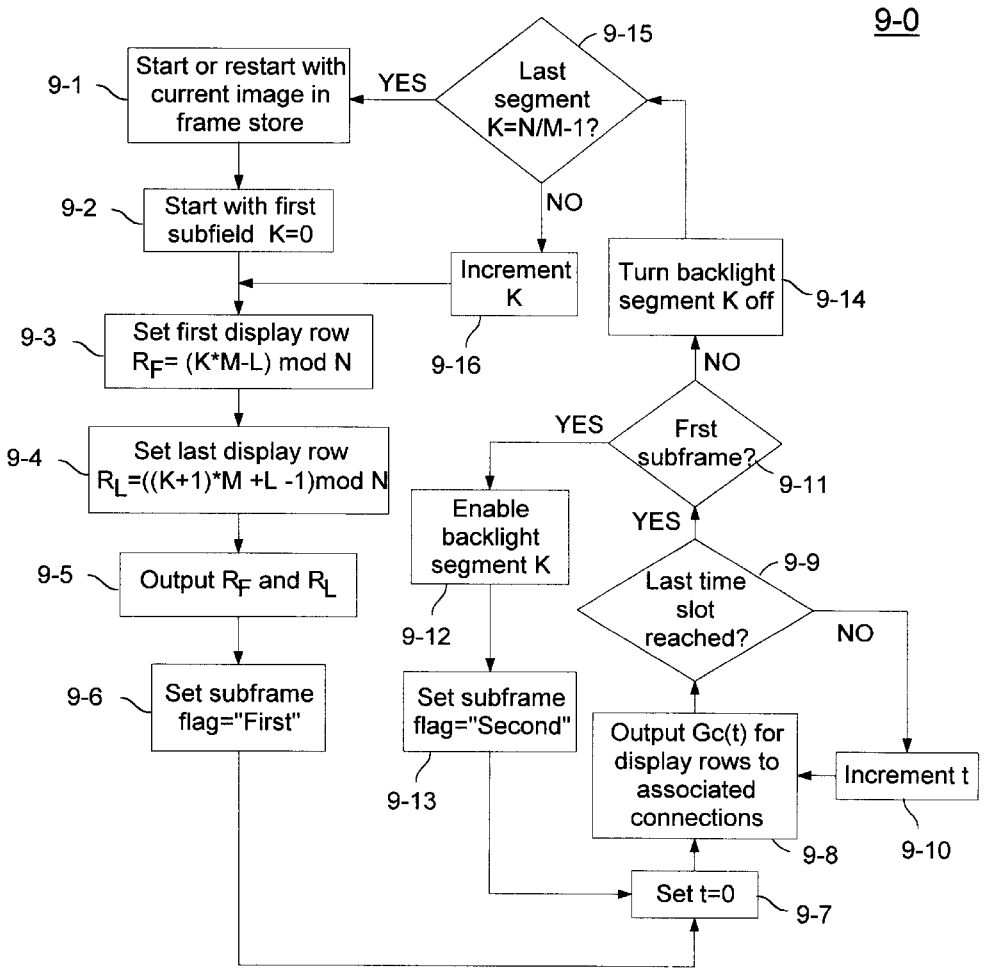
FIG. 9 illustrates steps of a method by which the illustrative embodiment displays an image in multiple fields.

FIG. 9 shows a method 9-0 by which the inventive display system 5-0, in its illustrative embodiment, displays a digital image 5-1. The method begins at step 9-1 with a new or updated image in the frame store 5-3. At step 9-2, a variable K is initialized to 0 to indicate that the current subfield is the one centered on the first backlight segment. In steps 9-3 and 9-4, the controller 5-2 initializes the current field by setting the beginning of the range of addressed rows $R_F$ and the end of the current range of displayed rows to be $R_L$, where these two numbers are given by Eq. (5). This arithmetic is done modulo N, where N is the actual number of rows in the display. This method is also appropriate when two systems are combined in a dual-scan arrangement and addressed synchronously. In that case, the bottom L lines of the upper system would be addressed along with the top subfield, which would compensate for parallax while the top field in the bottom system is displayed. At step 9-5, the controller outputs $R_F$ and $R_L$ to the frame store 5-3, which forwards the pixel data for these rows to the field store 5-4. The controller also outputs these two numbers to the row multiplexer 5-10, causing unaddressed rows to be grounded and addressed rows to receive the correct row waveform from the row drivers 5-9.

At step 9-6 of method 9-0, the controller 5-2 resets a subframe flag to "First" indicating that the first half 8-2 of a subframe 8-1 is in progress. Next, the controller initializes the time within the current half subframe at step 9-7. At steps 9-8 through 9-10, the column-signal generator 5-5 outputs the column waveforms to the column drivers 5-6. When the last time slot is detected at step 9-9, the controller tests the subframe flag. If the first half of the subframe was just completed, the method branches to step 9-12 where the current backlight segment K (5-12.K, 6-2.K) is enabled. The method then sets the subframe flag to "Second" at step 9-13 to show that the second half of a subframe is in progress and returns to step 9-7 to begin outputting the same column waveforms again. When this operation is completed, the subframe flag is tested at step 9-11 again and the method branches to step 9-14, where the backlight is turned off. Next, at step 9-15, the controller tests whether K has reached N/M−1 yet, which would indicate the completion of a frame. If the frame is not complete, K is incremented at step 9-16 and the method displays the next field starting at step 9-3. If the frame is complete, the method branches to step 9-1 to begin displaying a new frame.

The on/off voltage ratio available in the illustrative embodiment with M+2L+1=25 is 1.22, compared to about 1.067 for 240-line multiplexing. As is well known in the art, along with a significant reduction in the multiplex ratio, substantially improved contrast and a wider horizontal viewing-angle range parallel to the rows can be obtained. The liquid-crystal material also has up to 15.6 msec. to turn off before being addressed again at a 60 Hz frame rate. However, a liquid-crystal having a turn-on response time substantially less than 1.1 msec is required.

The horizontal and vertical viewing-angle ranges can also be expanded without driving extra rows above and below the current subfield. For example, a diffusive screen that combines the desired horizontal and vertical viewing-angle ranges with ambient-light rejection could be placed in front of the inventive display system. John R. DiLoreto and Dennis W. Vance disclosed high-contrast screens of this type in U.S. Pat. No. 6,076,933, "Light Transmitting and Dispersing Filter Having Low Reflectance," which was issued on Jun. 20, 2000. The backlight should be collimated in such a system, making the viewing-angle characteristics of the LCD itself less critical. Scott M. Zimmerman, Karl W. Beeson and Paul M. Ferm disclosed a collimation technique in U.S. Pat. No. 5,598,281, "Backlight Assembly for Improved Illumination Employing Tapered Optical Elements," which issued on Jan. 28, 1997. Unfortunately, such high-contrast screens and collimating layers are expensive.

Figure 10:
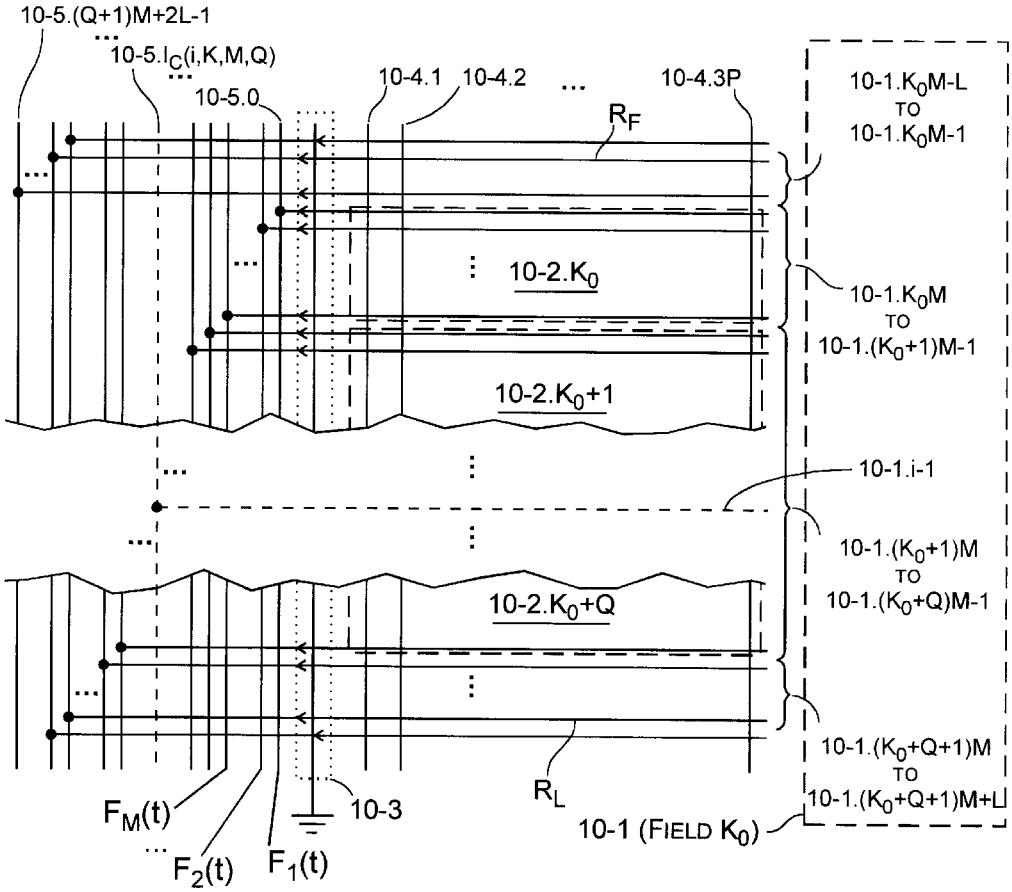
FIG. 10 illustrates the connection pattern of the row drivers to the LCD in a second embodiment of the invention.

FIG. 10 shows how the rows may be connected in a second embodiment of the inventive display system 5-0. In the second embodiment, a liquid-crystal configuration with a slower response time can be employed, if necessary, at the expense of a higher multiplex ratio. The multiplex ratio can nevertheless be substantially less than the total number of rows N in the display resulting in improved contrast and an increased horizontal viewing-angle range. As before, the row multiplexer (5-10, 10-3) has switches for independently connecting each row of the LCD. However, a field is addressed by (Q+1)M+2L voltage waveforms. These waveforms are received from the row drivers 5-9 through the leads 10-5.0 through 10-5.QM+2L−1. When a reference field $K_0$ 10-1 is addressed, the leads are connected in ascending order starting with the first row of subfield $K_0$, which is labeled 10-1.$K_0$M. The connection pattern wraps around to finish with the rows labeled 10-1.$K_0$M−L through 10-1.$K_0$M−1, which are in subfield $K_0$−1. The remaining switches are reset to ground the un-addressed rows of the LCD.

Figure 11:
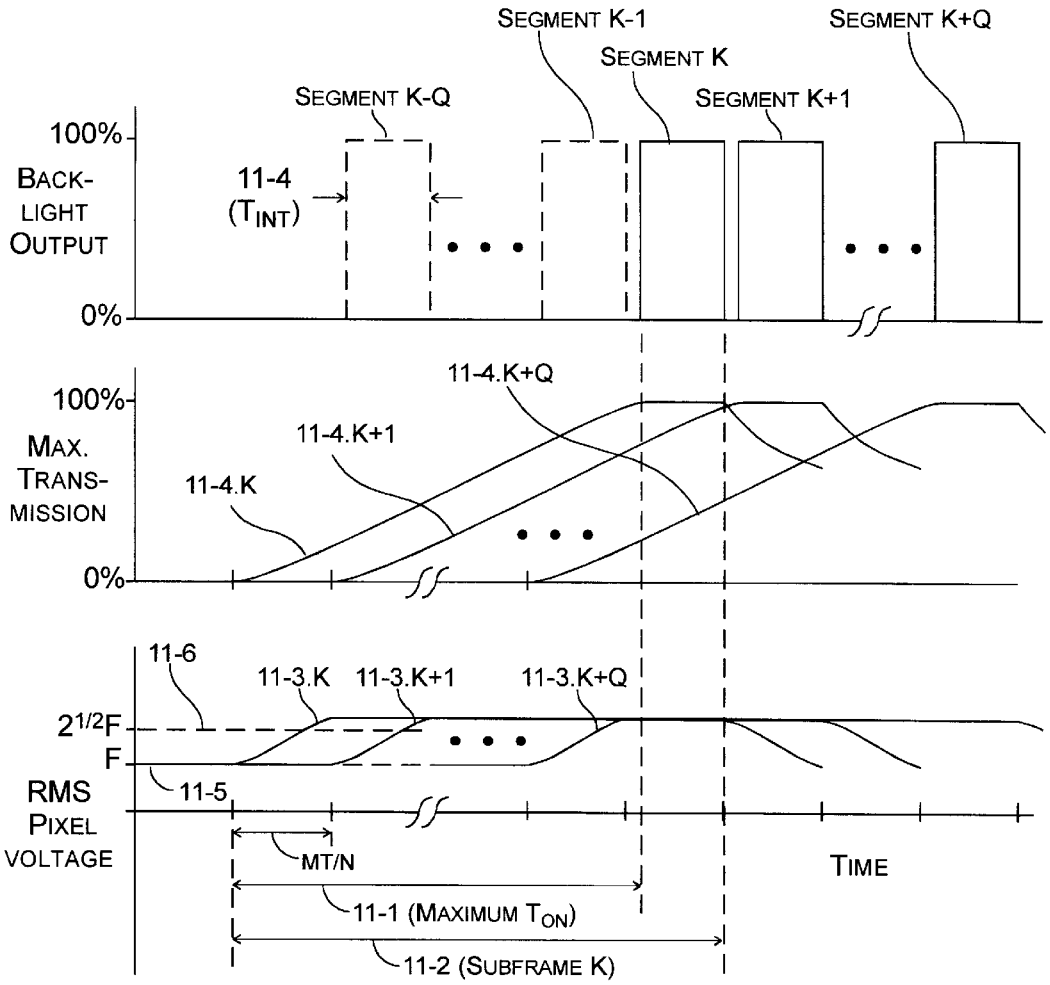
FIG. 11 illustrates the pixel voltage, backlight segment output and maximum pixel transmission as functions of time in the second embodiment.

FIG. 11 shows the RMS voltage applied to pixels in subfields [K, K+1, . . . K+Q], the transmission of pixels that would be turned on fully in this range of subfields, and the timing of the light output of the associated backlight segments. The frame time T is divided into N/M overlapping subframes of equal duration (Q+1)MT/N spaced MT/N apart. Subframe K 11-2 starts at time KMT/N and ends at (K+Q+1)MT/N. A set of orthogonal functions is chosen having period MT/N, and an RMS voltage at t is defined over the period MT/N ending at that time. All of the rows in subfield K, which in FIG. 10 are labeled 10-1.KM to 10-1.(K+1)M−1, are addressed during each period MT/N of subframe K, and backlight segment K is pulsed during the last period. The pixel transmission is shown substantially saturated within a maximum time $T_{ON}$ 11-1.

To reduce the computation load on the column-signal generator 5-5, it is advantageous to apply the same orthogonal function to each row of a subfield during the Q+1 successive periods MT/N of the subframe during which all of its pixels are addressed. With the additional condition that (Q+1)M is also a divisor of N, a set of (Q+1)M orthogonal functions can be labeled with a row index 1+(i−1) mod M offset by 0, M, . . . ,QM:

$$I(i,K,M,Q)=1+(i-1)\bmod M+M(K\bmod(Q+1)). \tag{15}$$

To minimize parallax degradation, it is also advantageous to address the first L rows of segment K+Q+1 and the last L rows of segment K−1 during the last period MT/N of subframe K. The functions associated with these rows can be consistently labeled by:

$$\begin{aligned} I_+(i,L,M,Q)&=1+(i-1)\bmod L+M(Q+1),\\ I_-(i,L,M,Q)&=L+1+(i-1)\bmod L+M(Q+1),\\ I_0(L,M,Q)&=2L+1+M(Q+1). \end{aligned} \tag{16}$$

In all, M(Q+1)+2L+1 distinct labels are provided.

Figure 12:
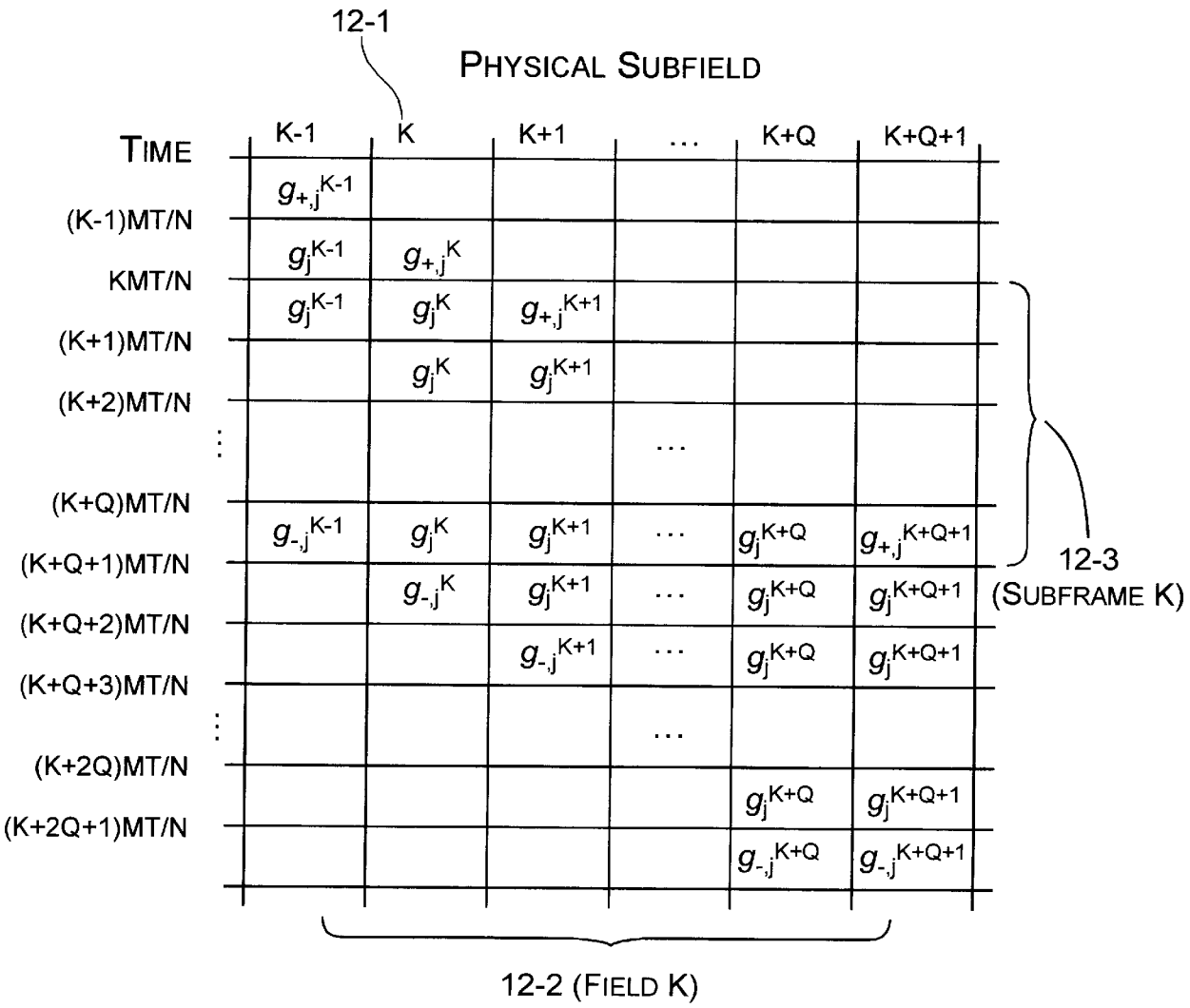
FIG. 12 illustrates the re-use of calculated parts of the column signals in the second embodiment.

FIG. 12 shows that the column waveforms that address subfield K 12-1 contain the function:

$$g_j^K(t)=\left(\frac{1}{(Q+1)M+2L+1}\right)^{1/2}\sum_{i=1+KM}^{(K+1)M}F_{I(i,K,M,Q)}(t)I_{ij}. \tag{17}$$

in all periods MT/N of subframe K (11-2, 12-3). In the period before subframe K begins, the extra function:

$$g_{+,j}^K(t)=\left(\frac{1}{(Q+1)M+2L+1}\right)^{1/2}\times\sum_{i=1+(KM)\bmod N}^{1+(KM+L-1)\bmod N}F_{I_+(i,L,M,Q)}(t)I_{ij} \tag{18}$$

is also added to the column waveforms. This ensures that the pixels in these rows have been addressed for at least $T_{ON}$ 11-1 to compensate for parallax when backlight segment K−1 is pulsed. In the last period of subframe K, backlight segment K is pulsed. In the next period, backlight segment K+1 is pulsed, and the function:

$$g_{-,j}^K(t)=\left(\frac{1}{(Q+1)M+2L+1}\right)^{1/2}\times\sum_{i=1+((K+1)M-L)\bmod N}^{1+((K+1)M-1)\bmod N}F_{I_-(i,L,M,Q)}(t)I_{ij} \tag{19}$$

is added to eliminate parallax. Distinct functions defined by Eqs. (18)–(19) are only used in one period MT/N per frame, so they cannot be reused if the image is not static. Using the definitions in Eqs. (15) through (18), the functions with which the column-signal generator 5-5 addresses field K can be written:

$$G_j^K(t)=\sum_{K'=K}^{(K+Q)\bmod N/M}g_j^{K'}(t)+g_{+,j}^{(K+Q+1)\bmod N/M}(t)+g_{-,j}^{(K-1)\bmod N/M}(t)+\left(\begin{array}{l}(Q+1)M+2L+1-\sum_{i=1+(KM-L)\bmod N}^{1+(KM-1)\bmod N}I_{ij}^2-\\ \sum_{K'=K}^{(K+Q)\bmod N/M}\overline{\left(g_j^{K'}\right)^2}-\sum_{i=1+((K+Q)M)\bmod N}^{1+((K+Q)M+L-1)\bmod N}I_{ij}^2\end{array}\right)^{12}\frac{F_{I_0(L,M,Q)}(t)}{((Q+1)M+2L+1)^{1/2}}. \tag{20}$$

The last orthogonal function with index $I_0$(L, M, Q) is used to compensate for the fact that the pixel values are defined over a continuous range. The sum of the squares of the pixel values associated with backlight segment K:

$$\overline{(g_j^K)^2} = \sum_{i=1+KM}^{(K+1)M} I_{ij}^2. \tag{21}$$

can advantageously be calculated once in each frame, stored, and re-used Q times.

The row multiplexer (5-10, 10-3) has switches for connecting each of the N rows to one of (Q+1)M+2L leads as shown in FIG. 10. The leads are connected to the rows of the display in a cyclical pattern with period (Q+1)M+2L. The first and last rows of field of field K are:

$$R_F=(KM-L)\bmod N,$$

$$R_L=((K+Q+1)M+L-1)\bmod N, \tag{22}$$

Before passing the (Q+1)M+2L signals on to the row drivers, the row-signal generator 5-8 distributes the waveforms through the row drivers 5-9 to the fixed leads 10-5.0 through 10-5. (Q+1)M+2L−1 in a way that minimizes the computational load on the column-signal generator 5-5. Functions $F_1 \ldots F_M$ are applied to the leads 10-5.0 through 10-5.M−1 while subfield $K_0$ is addressed in each period MT/N of reference subframe $K_0$. In the last period of reference subframe $K_0$, $F_{M+1} \ldots F_{2M}$ are applied to leads 10-5.M through 10-5.2M−1 and so on up to $F_{1+QM} \ldots F_{M+QM}$, which are applied to leads 10-5.QM . . . 10-5. (Q+1)M−1. The functions corresponding to the indices $I_+$(i, L, M, Q) of Eq. (16) are applied to the first L rows in subfield $K_0$+Q+1 through the next L leads and the functions corresponding to the indices I_(i, L, M, Q) are applied to the last L rows of subfield $K_0$−1. If $K_0$ is the first subfield of the display then $K_0$−1, being evaluated modulo N, indicates the last one.

FIG. 12 shows the pattern with which the terms defined in Eqs. (17)–(19) are selected in Eq. (20). The functions that are used in a particular period are arranged horizontally. The column waveforms have been defined so that the same functions $g_j^K$ can be used in all the periods-of subframe K (11-2, 12-3). Thus the column waveform generator does not need to calculate these terms more than once in each frame if storage is provided for them. Eq. (15) relates the orthogonal function index I(i, K, M, Q) to the row number i consistent with this approach. However, the connection 10-5.$I_C$ must also be related to the row number. As shown in FIG. 10, the connections are aligned with the rows for i=1+$K_0$M . . . ($K_0$+1)M. The connection number $I_C$ for a general value of i is therefore given by:

$$I_C=(i-1-K_0M)\bmod((Q+1)M+2L). \tag{23}$$

A table of function indices I(i, K, M, Q) vs connection numbers $I_C$(i, K, L, M, Q) can be compiled from Eqs. (23) and (15) by evaluating both for each value of i in [1, N].

Figure 13:
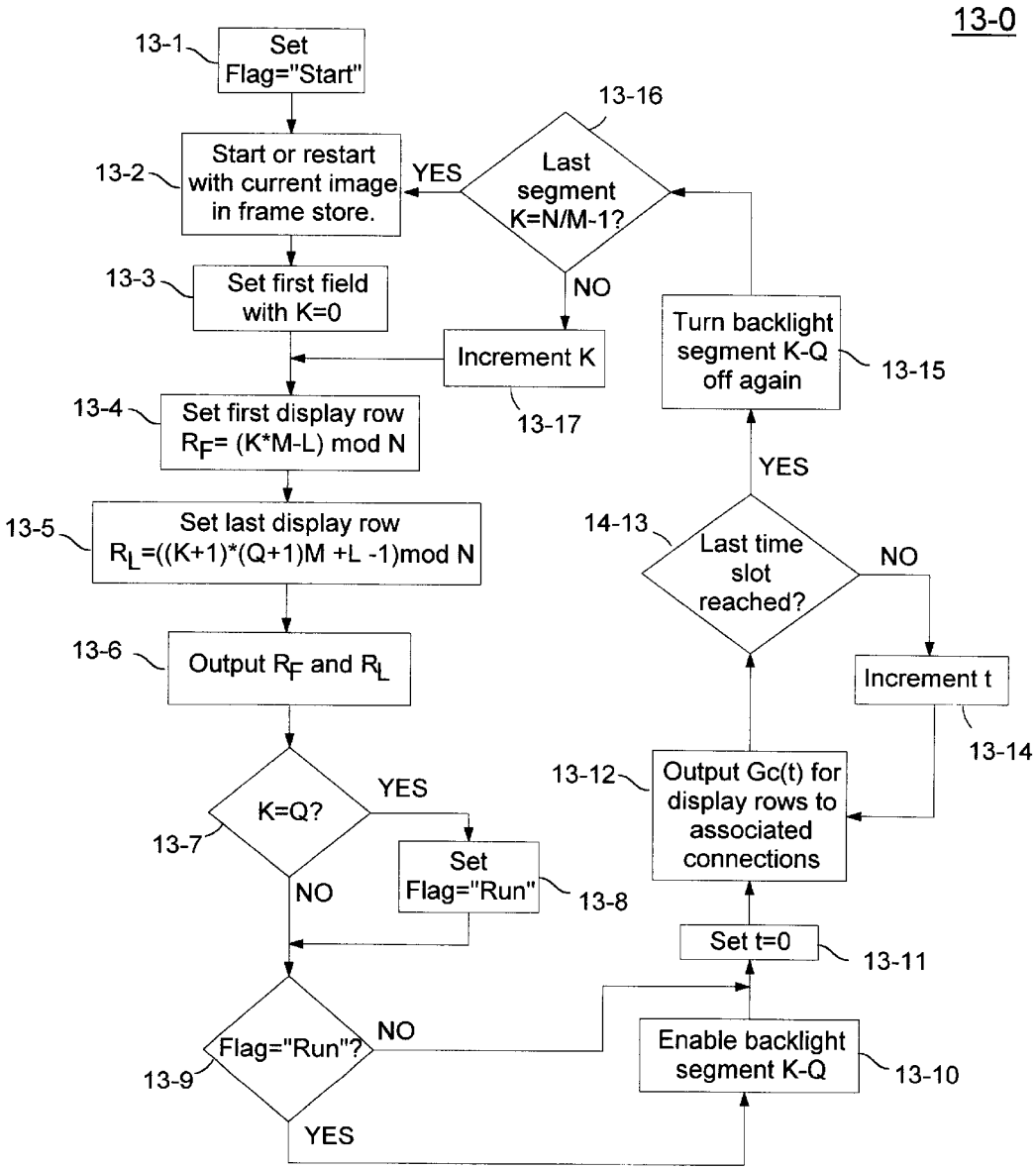
FIG. 13 illustrates steps of a method by which the second embodiment displays an image in multiple overlapping fields.

FIG. 13 shows steps of a method 13-0 that the second embodiment of the inventive display system 5-0 uses to display a digital image 5-1. The method begins at 13-1 by setting a flag to the value "Start," which will inhibit the backlight until the rows in the first subfield have been addressed for Q periods of length MT/N. At step 13-2, the method continues with a new or updated image in the frame store 5-3. At step 13-3, a variable K is initialized to 0 to indicate that a new frame is to be addressed starting with subfield 0. In steps 13-4 and 13-5, the controller 5-2 initializes the current field by setting the beginning of the range of addressed rows to be $R_F$ and the end of the current range of addressed rows to be $R_L$, where these two numbers are given by Eq. (22). This arithmetic is done modulo N, where N is the actual number of rows in the display. This method is also appropriate when two systems are combined in a dual-scan arrangement and addressed synchronously. In that case, the bottom L lines of the upper system would be addressed in the first field, which would compensate for parallax while the top subfield is displayed in the bottom system. At step 13-6, the controller outputs $R_F$ and $R_L$ to the frame store 5-3, which forwards the pixel data for these rows to the field store 5-4. The controller also outputs these two numbers to the row-signal generator 5-8 and to the row multiplexer 5-10, causing unaddressed rows to be grounded and addressed rows to receive the correct row waveform from the row drivers 5-9.

At step 13-7, the method 13-0 tests the current subfield K 12-1. If K is not equal to Q, the method branches to step 13-9, where the flag is tested. If K=Q, which indicates that the rows associated with segment 0 have been addressed for Q subfields, the method branches to step 13-8, where the flag is set to "Run." Processing then continues at step 13-9. If the flag has not been set to "Run," the method branches to step 13-11, with the backlight disabled. If the flag has been set to "Run," backlight segment K−Q is enabled at step 13-10. At steps 13-11 through 13-14, the column-signal generator 5-5 outputs the column waveforms to the column drivers 5-6. When the last time slot is detected at step 13-13, the method branches to step 13-15 where backlight segment K−Q (5-12.K−Q, 10-1.K−Q) is turned off. Next, at step 13-16, the controller tests whether K has reached N/M−1 yet, which would indicate that the current frame has been completely addressed and the next frame is about to begin. If the current frame has not yet been completely addressed, K is incremented at step 13-17 and the method begins the next field starting at step 13-4. If a new frame is to begin, the method branches to step 13-2 to begin displaying the new frame.

In one example of the second embodiment, with N=240, M=15, L=4, Q=1, and a frame rate of 60 Hz, the number of orthogonal functions with period MT/N=1.04 msec. that must be provided is (Q+1)M+2L+1=39. With these choices, N/M=16 is divisible by Q+1=2, so the pattern of assigning functions to groups of 15 rows also works when the addressing range still includes rows at the bottom of the display after rows at the top of the display are being addressed again. The highest frequency associated with this set of functions can actually be lower than in the comparable example of the illustrative embodiment. Only 25 functions were used there, but their period was half as long. The on/off RMS voltage ratio for the effective multiplex ratio of 39 is about 1.18. This is still a substantial improvement compared to a multiplex ratio of 240. Furthermore, the required turn-on response time of the liquid crystal is between 1.04 msec. and 2.08 msec. minus the integration time. The time available for the liquid crystal to turn off again is reduced to 13.5 msec because some rows are driven for an extra period to overcome parallax. Alternatively, one can choose N=240, M=16, L=4 and Q=2 for a multiplex ratio of (Q+1)M+2L+1=57. Here N/M=15 has Q+1=3 as a divisor. The highest frequency associated with this set of functions is only a little higher than the example given in the illustrative embodiment. However, the response time can be in the range of 2.22 msec. to 3.33 msec minus the necessary integration time.

In the second embodiment, the overlapping fields allow the backlight to achieve a higher duty cycle approaching 100% if the turn-on response time is QMT/N or less. Thus another advantage of the second embodiment is a brighter image as compared to the illustrative embodiment. The examples given with N=240 were chosen primarily for a dual-scan VGA or standard-definition TV display having 480 rows of pixels. If a large-area computer or high-definition TV display is required, N=384 is an effective choice because a dual-scan configuration would have 768 rows as required for the XGA format, which also accommodates the 720p high-definition TV format efficiently. In this case, N=384, M=16, L=4 and Q=2 or 3 are possible configurations with minimal computation because N is divisible by M(Q+1) in both cases. At a 60 Hz frame rate, MT/N is about 0.7 msec. The required liquid-crystal turn-on time could be in the range of 1.4 to 2.1 msec. with a multiplex ratio of 57 or in the range 2.1 to 2.8 msec. with a multiplex ratio of 73.

The number of periods Q in which subfields are pre-addressed before being illuminated is limited by the turn-off time of the liquid crystal. For example, if the turn-off time is about ⅓ of the frame time T, the maximum integer value of Q is 2 in the case that N=240 and M=16 if pixels are to relax back to 10% transmission between frames. Pixels in the middle of a subfield are therefore pre-addressed for 2.22 msec when the frame rate is 60 Hz. However, pixels in the first L rows of a subfield are pre-addressed for 3.33 msec. If the turn-on time is greater than 2.22 msec, the first L rows will appear brighter than rest of the subfield even when viewed in the center of the viewing-angle range.

Figure 14:
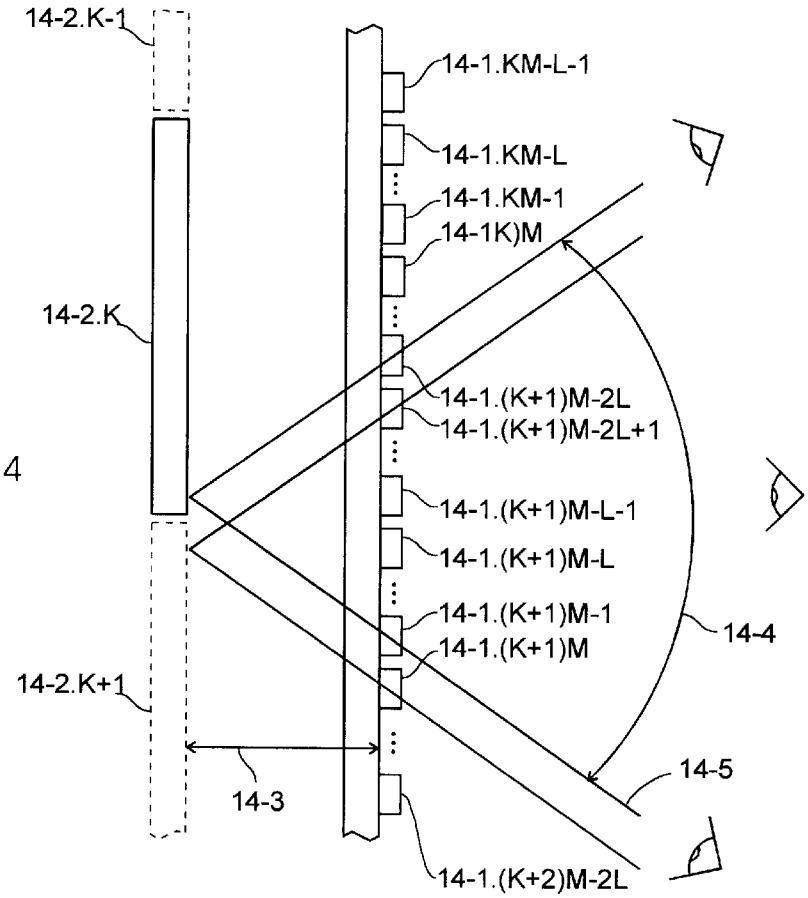
FIG. 14 illustrates an offset between subfields and backlight segments employed in a third embodiment to provide an expanded vertical viewing-angle range.

FIG. 14 shows a third embodiment in which all the pixels in each subfield are addressed equally. No extra rows are driven to expand the viewing-angle range, and the number of row-drivers is (Q+1)M, which is advantageously a divisor of N as in the second embodiment. Each subfield is offset with respect to its corresponding backlight segment in the direction of scanning. As shown in FIG. 14, this offset places rows 14-1. (K+1)M−2L through 14-1.(K+M)−1, which are actually in subfield K, in front of backlight segment K+1. They are illuminated by backlight segment K only as viewed from directions 14-5 near the boundary of the expanded viewing-angle range 14-4 in planes perpendicular to the rows. The viewing-angle range is expanded by adjusting the transmittance of pixels in each subfield at the time when the next backlight segment is activated. At this time the pixels in subfield K are no longer being addressed, and they are relaxing towards the light blocking state. However, each pixel is relaxing from the state it reached at the end of the addressing time, which lasted for (Q+1)MT/N. The transmission afterwards is not constant, but it remains independent of the image except for each pixel's own pixel value. Consequently the appearance of pixels can be made uniform throughout the expanded viewing-angle range even if the addressing time is substantially less than $T_{ON}$.

Figure 15:
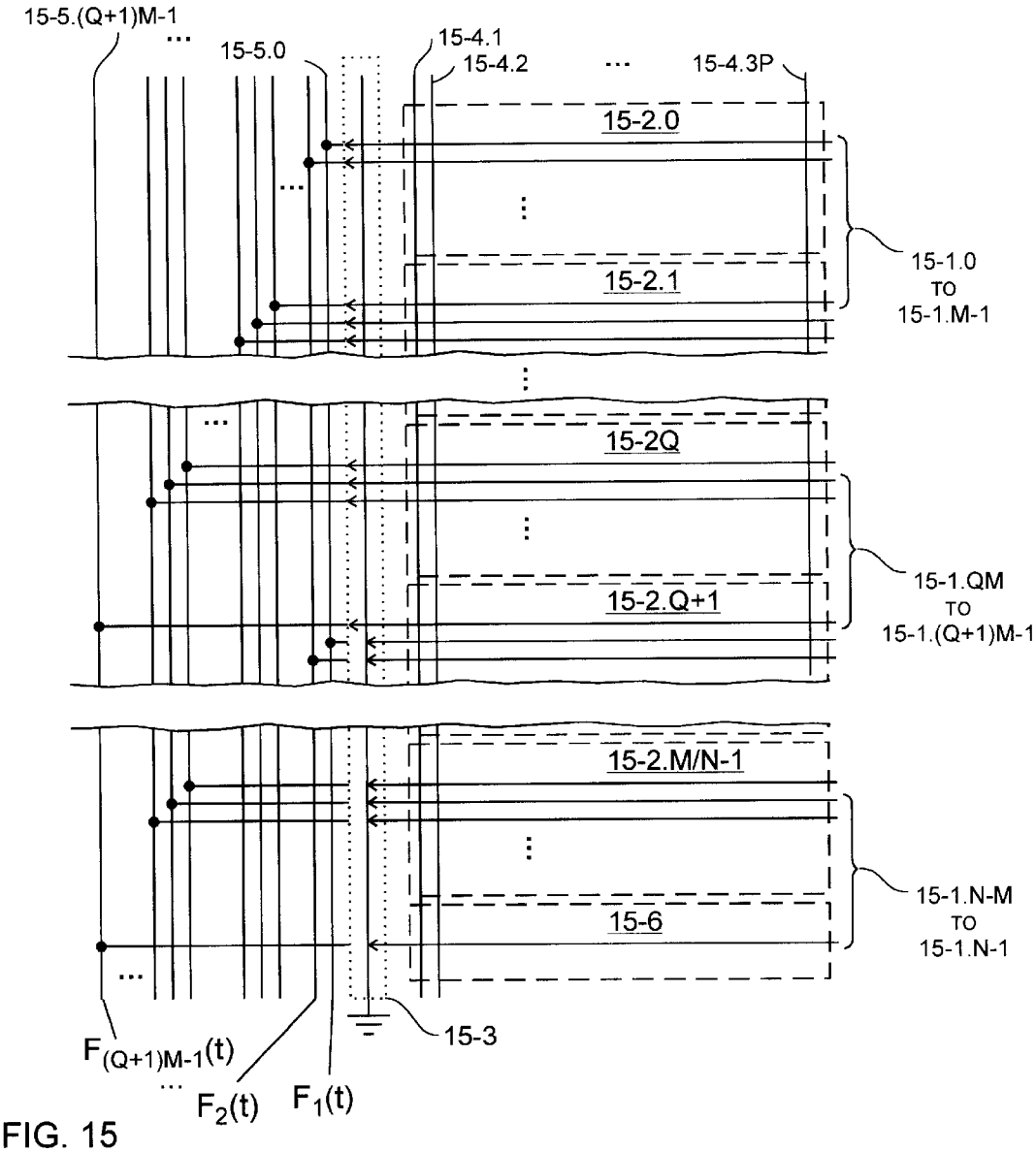
FIG. 15 illustrates the simple connection pattern of the row drivers to the LCD in the third embodiment of the invention.

FIG. 15 shows a simple connection pattern that is useful in the third embodiment when (Q+1)M is a divisor of N. The N rows are connected in ascending order to the (Q+1)M drivers periodically through the lines 15-5.0 through 15-5. (Q+1)M−1. The switches in the row multiplexer 15-3 are shown set to address field 0, which contains rows 15-1.0 through 15-1. (Q+1)M−1. An extra backlight segment 15-6 is provided to illuminate the bottom L rows at the same time that segment 0 is activated. In a dual-scan arrangment, illumination of the bottom L rows of the upper display would come from the top segment of the bottom display. Only the bottom display would therefore need the extra backlight segment 15-6. The last L rows of the bottom display can equally well be illuminated at the same time that the bottom full backlight segment 15-2.M/N−1 is activated. Accordingly, segment 15-2.M/N−1 could alternatively be extended to illuminate the last L rows.

Figure 16:
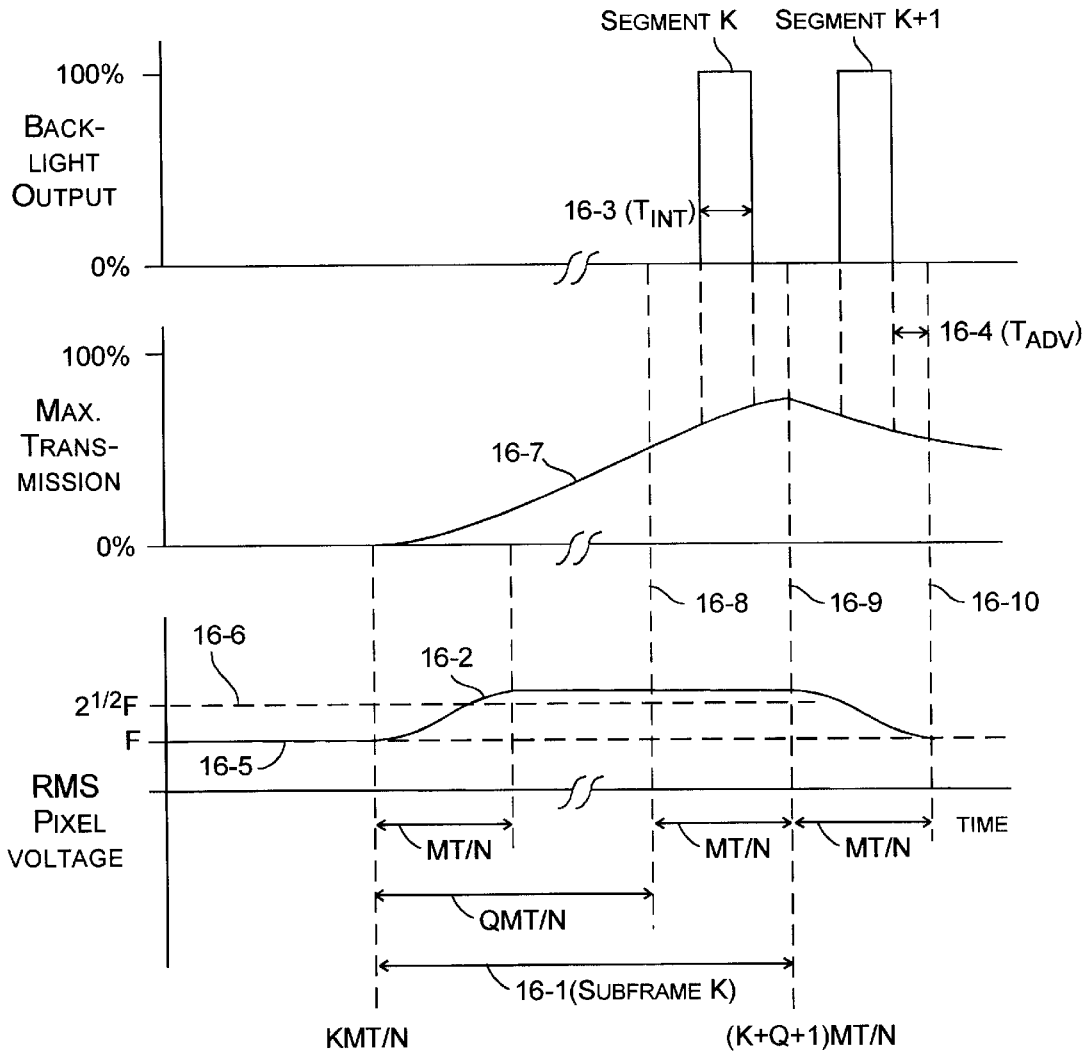
FIG. 16 illustrates the timing during which pixels are addressed and illuminated by adjacent backlight segments, which provides an expanded viewing-angle range in the third embodiment.

FIG. 16 shows the timing of the waveform 16-2 that addresses subfield K and the timing of its illumination by backlight segments K and K+1. Because of the offset, rows in subfield K are not illuminated by segment K−1 within the expanded vertical viewing-angle range 14-4. However, some rows in subfield K are illuminated by backlight segment K+1 as viewed from certain directions. The transmission of pixels in these rows is equalized with that of pixels of subfield K that are illuminated by segment K by advancing the; illumination by $T_{ADV}$ 16-4. This equalization is not possible if the pixel transmission is substantially saturated at the beginning 16-8 of the period MT/N in which segment K is illuminated. In that case, however, the second embodiment will be substantially uniform. Equalization is generally possible when pixel transmission rises during the period from time 16-8 to time 16-9 in which segment K emits light more than it falls during the period from 16-9 to 16-10 in which segment K+1 emits light. However, the integration time $T_{INT}$ 16-3 consistent with equalization decreases as the pixel transmission at 16-8 goes below the transmission at 16-10. In such cases, a backlight that has higher peak brightness will be required to compensate for the reduced integration time required for equalization.

Equalization requires balancing the integrals of the transmission of a pixel in subfield K during the intervals in which backlight segments K and K+1 are active. The first term is given by:

$$I_{ij}\int_{(Q+1)MT/N-T_{INT}-T_{ADV}}^{(Q+1)MT/N-T_{ADV}} dt(1-e^{-t/\tau_{ON}}), \tag{24}$$

as the transmission is increasing with time constant $\tau_{ON}$. According to common practice, the turn-on time is considered to be $T_{ON}=2.3\tau_{ON}$, which is the time required for the exponential to build up to 90% of its saturated level. The proportionality constant is the addressed pixel transmission $I_{ij}$ for the pixel in question. The second term is given by:

$$I_{ij}(1-e^{-(Q+1)MT/N\tau_{ON}})\int_{MT/N-T_{INT}-T_{ADV}}^{MT/N-T_{ADV}} e^{-t/\tau_{OFF}}\,dt, \tag{25}$$

because the pixel transmission relaxes with time constant $\tau_{OFF}$ from the value it reached when addressing was discontinued. The equalization condition is conveniently written:

$$T_{INT}-\tau_{ON}e^{-y}e^{T_{ADV}/\tau_{ON}}(e^{T_{INT}/\tau_{ON}}-1)=\tau_{OFF}(1-e^{-y})e^{-x}e^{T_{ADV}/\tau_{OFF}}(e^{T_{INT}/\tau_{OFF}}-1), \tag{26}$$

with $x=MT/N\tau_{OFF}$ and $y=(Q+1)MT/N\tau_{ON}$. Generally, Q should be made -& large so that the light emitted by the backlight can be used efficiently. However, if Q is made too large, there will not be enough time for the pixels to relax between frames.

Eq. (26) can be solved by numerical techniques when appropriate constraints are placed on of some of the parameters. If pixels should relax by 90% or more between frames, then the allowed values of Q must satisfy:

$$Q \le \left(1-2.3\frac{\tau_{OFF}}{T}\right)\frac{N}{M}. \tag{27}$$

Figure 17:
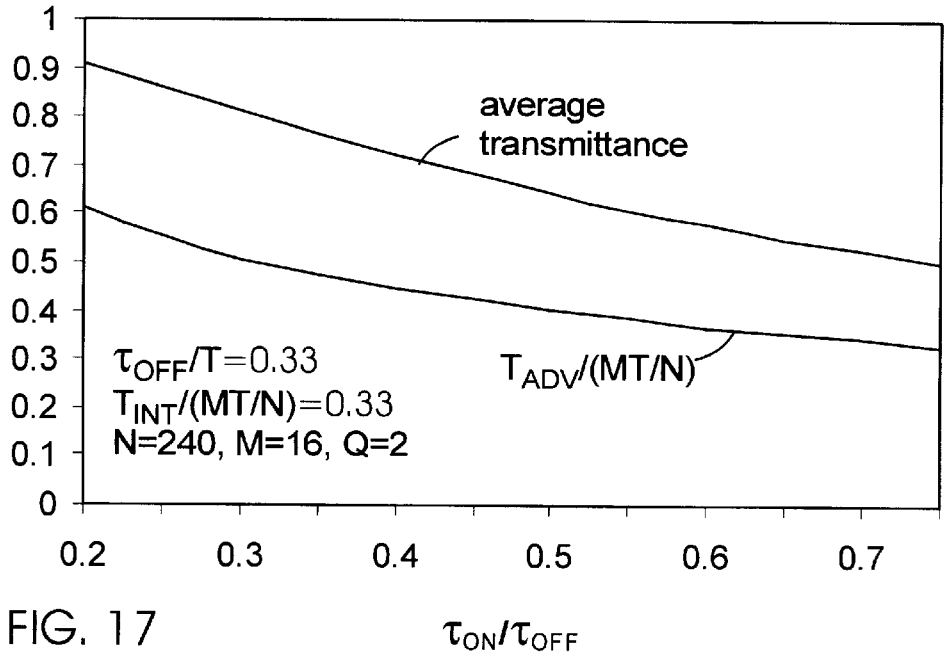
FIG. 17 illustrates timing relations that equalize the brightness of pixels illuminated by adjacent backlight segments in the third embodiment.

For example, with N=240 and M=16, the maximum value of Q is 2 when $\tau_{OFF}/T=0.33$. Eq. (26) can be solved for $T_{ADV}/T$ as a function of $\tau_{ON}/\tau_{OFF}$ if M, N, Q and $T_{INT}/(MT/N)$ are given. The next step is to pick a value of $T_{INT}/(MT/N)$. Eq. (25) is valid only if $T_{INT}+T_{ADV}$ is less than MT/N, and therefore the range over which $T_{ADV}$ can be varied to solve Eq. (26) is equal to (MT/N)−$T_{INT}$. Reducing $T_{INT}$ to provide room for $T_{ADV}$ to be varied in order to produce a solution is generally acceptable provided the backlight can produce a higher peak output to compensate. FIG. 17 shows $T_{ADV}$/(MT/N) as a function of $\tau_{ON}/\tau_{OFF}$ in the example N=240, M=16, Q=2 and $\tau_{OFF}$/T and $T_{INT}$/(MT/N) are both equal to 0.33. The average transmittance is also plotted, and it is above 90% for values of $\tau_{ON}/\tau_{OFF}$ below 0.20. The solution breaks down at such values because $T_{ADV}+T_{INT}$ rises above MT/N. However, the average transmittance is substantially above 90% in that range, so the second embodiment could be used. FIG. 17 shows that solutions exist over a wide range of $\tau_{ON}/\tau_{OFF}$, and the average transmission remains above 50% even up to $\tau_{ON}/\tau_{OFF}$=0.75. This reduced average transmission is acceptable in a large-area display for family entertainment where low cost is currently more important than high efficiency. However, it is necessary to increase the peak intensity of the backlight to compensate for it.

While the invention has been described by reference to specific embodiments, this was for purposes of illustration only. Numerous alternative embodiments will be apparent to those skilled in the art and are considered to be within the scope of the invention.

What is claimed is:

1. A display system comprising:

an array of light valves arranged in rows and columns in a plane, wherein the total number of said rows is a positive integer N, each said light valve having a first and second electrical input, said light valves having a range of transmittance of light for pixel values in an addressing range of voltage applied between said inputs, said light valves substantially blocking light below said addressing range of voltage applied between said inputs, said light valves transmitting light within a turn-on time after said applied voltage increases to a value in said addressing range of voltage, said light valves substantially blocking light again within a turn-off time after said applied voltage returns to a value below said addressing range of voltage, an array of row drivers which each apply a select voltage waveform through a row conductor to said first inputs of said light valves disposed in one of said rows of light valves, an array of column drivers which each apply a data voltage waveform through a column conductor to said second input of each said light valve disposed in one of said columns of light valves, a backlight comprising an array of backlight segments arranged in a plane parallel to said plane of said light valves, each said segment being positioned to illuminate a corresponding subfield of M contiguous said rows of said light valves as seen from a first viewing-angle range in planes perpendicular to said rows of light valves, wherein said display system addresses said array of light valves in a field containing Q+1 contiguous subfields, where Q is a non-negative integer, by applying specific select voltage waveforms to said row conductors and computed data voltage waveforms to said column conductors connected to said light valves in said field thereby impressing voltages in said addressing range between said first input and said second input of said light valves in said field, wherein, further, said display system displays one of said subfields by causing said corresponding backlight segment to illuminate said light valves in said one subfield after said one subfield has been addressed for at least said turn-on time, said illumination continuing for an integration time while said addressing continues for a total addressing time, said light valves transmitting said illumination in proportion to predetermined said pixel values for each said light valve in said one subfield, wherein, further, N/M is a positive integer and said system displays an image in a frame time T by sequentially displaying said N/M subfields of said image in consecutive periods MT/N, said backlight segment illuminating said corresponding subfield of said light valves only after said corresponding subfield has been addressed for at least Q said periods MT/N and during a final said period of said addressing time lasting for (Q+1)MT/N, wherein, further, said addressing and said illuminating advance by one subfield after each said period MT/N, thereby allowing consecutive subfields to be illuminated by said corresponding backlight segments in consecutive said periods MT/N to display said images even if said turn-on time is longer than said period MT/N, wherein, finally, said system displays moving images by receiving and displaying multiple frames at a frame rate which allows at least said turn-off time between times when said subfields are addressed, said integration time being a small fraction of said frame time T which is the reciprocal of said frame rate thereby reducing smearing visual effects which occur if said light valves are illuminated when said transmittance is uncontrolled and at other times in said frame time T when said pixel values lag said moving images.

2. The display system of claim 1 wherein each said field includes additional rows adjacent to said at least one subfield thereby allowing said backlight segment to illuminate said light valves in said additional adjacent rows as seen from an expanded range of angles compared to said first range of angles in planes perpendicular to said rows.

3. A dual-scan display system comprising top and bottom display systems according to claim 2 which are juxtaposed and operated synchronously to provide said expanded range of angles by causing at least one of said additional rows of said top system to be addressed when illuminated by a top backlight segment of said bottom display system and at least one of said additional rows of said bottom system to be addressed when illuminated by a bottom backlight segment of said top system.

4. The display system of claim 1 wherein said array of light valves is defined by transparent row electrodes on a first substrate juxtaposed to transparent column electrodes on a second substrate with an RMS-responding material interposed between said substrates, said light transmission and said light blocking occurring at distinct RMS voltages applied to said RMS-responding material between said row and column conductors.

5. The display system of claim 4 wherein said RMS-responding material is a fast-responding supertwisted nematic liquid crystal situated between entrance and exit polarizers which allow light transmission through said display system in said range of transmittance.

6. The display system of claim 4 wherein said select voltage waveforms are each periodic in time with a period MT/N and said data voltage waveforms are proportional to the sum of the product of each said select voltage waveform multiplied by said pixel value of each said light valve in said column to which said data voltage waveform is applied, wherein the integral over said period MT/N of the product of any pair of distinct said select voltage waveforms vanishes and the average over said period MT/N of the square of the difference between any said select voltage waveform and any said data voltage waveform during said addressing time contains a first term which is independent of said image and a second term which depends on said pixel value of said particular RMS-responding light valve at which said any select voltage waveform and said any data voltage waveform appear, which causes said transmittance of said particular RMS-responding light valve to depend only on said pixel value after said addressing is maintained for said turn-on time, wherein, further, each said row conductor is grounded except during said addressing time of said light valves in said each row, and an additional select waveform is used in computing said data voltage waveforms with phantom pixel values chosen to cause said data voltage waveforms to have an RMS value which is independent of said image even though said pixel values produce a continuous range of transmittance, said RMS value of said data voltage waveforms being below and substantially different from said addressing voltage range, which causes said light valves to block light within said turn-off time after said addressing time ends, wherein, finally, each said backlight segment illuminates said RMS-responding light valves while said transmittance of said light valves depends only on said pixel value, thereby causing said image to be visible.

7. The display system of claim 6 wherein each said distinct field includes 2L additional said rows adjacent to said Q+1 contiguous subfields to provide an expanded viewing-angle range compared to said first viewing-angle range in planes perpendicular to said rows.

8. The display system of claim 7 wherein switches are provided for each said row in said display system, each said switch having a first setting which grounds said row conductor and a second setting which connects said row conductor to one of said row drivers, wherein, further, said distinct fields are defined by periodically assigning said switches to said row drivers with a period of rows (Q+1)M+2L, wherein, finally, Q+1 is a divisor of N/M to allow an assignment of said select voltage waveforms to said row drivers which is constant in successive said multiple frames.

9. The display system of claim 8 wherein an additional select waveform used in computing said data voltage waveforms with phantom pixel values chosen to cause said data voltage waveforms to have an RMS value which is independent of said image even though said pixel values produce a continuous range of transmittance, wherein, further, said RMS value of said data voltage waveforms is below and substantially different from said addressing voltage range and causes light valves to block light within said turn-off time after said addressing time ends and said first inputs are grounded, wherein, furthermore, said light valves respond to said substantial difference in RMS voltage during said addressing time by turning on in said turn-on time.

10. A display system comprising:

an array of light valves arranged in rows and columns in a plane, where the total number of said rows is a positive integer N, each said light valve having a first and second electrical input, said light valves having a range of transmittance of light for pixel values in an addressing range of voltage applied between said inputs, said light valves substantially blocking light below said addressing range of voltage applied between said inputs, said light valves being capable of transmitting light optimally within a turn-on time after said applied voltage increases to a value in said addressing range of voltage, said light valves substantially blocking light again within a turn-off time after said applied voltage returns to a value below said addressing range of voltage, an array of row drivers which each apply a select voltage waveform through a row conductor to said first inputs of said light valves disposed in one of said rows of light valves, an array of column drivers which each apply a data voltage waveform through a column conductor to said second input of each said light valve disposed in one of said columns of light valves, a backlight comprising an array of backlight segments arranged in a plane parallel to said plane of said light valves, each said segment being positioned to illuminate a corresponding subfield of M contiguous said rows of said light valves as seen from a first viewing-angle range in planes perpendicular to said rows of light valves, wherein said display system addresses said array of light valves in a field containing Q+1 contiguous subfields, where Q is a non-negative integer, by applying specific select voltage waveforms to said row conductors connected to said light valves in said field and computed data voltage waveforms to said column conductors connected to said light valves in said field thereby impressing voltages in said addressing range between said first input and said second input of said light valves in said field, wherein, further, said display system displays one of said subfields by causing said corresponding backlight segment to illuminate said light valves in said one subfield for an integration time which occurs while said one subfield is addressed, said light valves transmitting said illumination in proportion to predetermined said pixel values for each said light valve in said one subfield, wherein, further, N/M is a positive integer and said system displays an image in a frame time T by sequentially displaying said N/M subfields of said image in consecutive periods MT/N, each said backlight segment illuminating said corresponding subfield of said light valves only after said corresponding subfield has been addressed for at least Q periods MT/N and during a final said period MT/N of an addressing time lasting for (Q+1)MT/N, wherein, further, said addressing and said illuminating advance by one subfield after each said period MT/N, thereby allowing consecutive said subfields to be illuminated by said corresponding backlight segments in consecutive said periods MT/N, wherein, finally, said system displays moving images by receiving and displaying sequential frames at a frame rate which allows at least said turn-off time between times when said subfields are addressed, said integration time being a small fraction of said frame time T which is the reciprocal of said frame rate thereby reducing smearing visual effects which occur if said light valves are illuminated when said transmittance is uncontrolled and at other times in said frame time T when said pixel values lag said moving images.

11. The display system of claim 10 wherein said subfields are offset with respect to said corresponding backlight segments causing said first viewing-angle range to be offset in planes perpendicular to said rows, wherein, further, said integration time and said offset are chosen to provide an expanded viewing-angle range in which said light valves in rows which are contiguous with a next subfield are illuminated by a next backlight segment corresponding to said next subfield, wherein, finally, said integration time is chosen to make said light valves in said rows contiguous to said next subfield appear equally bright when illuminated by said corresponding backlight segment during said addressing time and when illuminated by said next backlight after said addressing time.

12. A dual-scan display system comprising top and bottom display systems according to claim 11 which are juxtaposed and operated synchronously causing a top backlight segment of said bottom display system to illuminate rows in said top display system contiguous with said bottom display system, thereby providing said expanded viewing-angle range.

13. The display system of claim 11 wherein said array of light valves is defined by transparent row electrodes on a first substrate juxtaposed to transparent column electrodes on a second substrate with an RMS-responding material interposed between said substrates, said light transmission and said light blocking occurring at distinct RMS voltages applied to said RMS-responding material between said row and column conductors.

14. The display system of claim 13 wherein said RMS-responding material is a fast-responding supertwisted nematic liquid crystal situated between entrance and exit polarizers which allow light transmission through said display system in said range of transmittance.

15. The display system of claim 13 wherein said select voltage waveforms are each periodic in time with said period MT/N and said data voltage waveforms are proportional to the sum of the product of each said select voltage waveform multiplied by said pixel value of each said light valve in said column to which said data voltage waveform is addressed, wherein the integral over said period MT/N of the product of any pair of distinct said select voltage waveforms vanishes and the average over said period MT/N of the square of the difference between any said select voltage waveform and any said data voltage waveform during said addressing time contains a first term which is independent of said image and a second term which depends on said pixel value of said particular RMS-responding light valve at which said any select voltage waveform and said any data voltage waveform appear, which causes said transmittance of said particular RMS-responding light valve to depend only on said pixel value, wherein, further, each said row conductor is grounded except during said addressing time of said light valves in said each row, and an additional select waveform is used in computing said data voltage waveforms with phantom-pixel values which cause said data voltage waveforms to have an RMS value which is independent of said image even though said pixel values produce a continuous range of transmittance, said RMS value of said data voltage waveforms being below and substantially different from said addressing voltage range causing said light valves to block light within said turn-off time after said addressing time ends, wherein, finally, each said backlight segment illuminates said EMS-responding light valves while said transmittance of said light valves respond to transitions in said applied voltage between said image-independent value which causes light blocking and said value in said addressing range which depends only on said pixel value, thereby causing said image to be visible.

16. The display system of claim 15 wherein switches are provided for each said row in said display system, each said switch having a first setting which grounds said row conductor and a second setting which connects said row conductor to one of said row drivers, wherein Q+1 is a divisor of N/M to allow an assignment of said select voltage waveforms to said row drivers which is constant.

* * * * *